US012339052B2

(12) United States Patent
Yao et al.

(10) Patent No.: US 12,339,052 B2
(45) Date of Patent: Jun. 24, 2025

(54) REFRIGERATOR

(71) Applicant: HISENSE RONSHEN (GUANGDONG) REFRIGERATOR CO., LTD., Guangdong (CN)

(72) Inventors: Huimin Yao, Guangdong (CN); Jinbo Gan, Guangdong (CN); Kunxiong Deng, Guangdong (CN); Xiaofeng Liu, Guangdong (CN); Zixuan Zhao, Guangdong (CN); Hao Weng, Guangdong (CN)

(73) Assignee: HISENSE RONSHEN (GUANGDONG) REFRIGERATOR CO., LTD., Foshan (CN)

( * ) Notice: Subject to any disclaimer, the term of this patent is extended or adjusted under 35 U.S.C. 154(b) by 784 days.

(21) Appl. No.: 17/565,926

(22) Filed: Dec. 30, 2021

(65) Prior Publication Data

US 2022/0154990 A1 May 19, 2022

Related U.S. Application Data

(63) Continuation-in-part of application No. PCT/CN2020/093363, filed on May 29, 2020.

(30) Foreign Application Priority Data

Sep. 3, 2019 (CN) ..... 201910829072.X
Sep. 3, 2019 (CN) ..... 201910829074.9
(Continued)

(51) Int. Cl.
*F25C 5/20* (2018.01)
*F25C 5/182* (2018.01)
*F25C 5/04* (2006.01)

(52) U.S. Cl.
CPC ..... *F25C 5/22* (2018.01); *F25C 5/182* (2013.01); *F25C 5/046* (2013.01); *F25C 2400/10* (2013.01); *F25C 2500/06* (2013.01)

(58) Field of Classification Search
CPC .. F25C 5/22; F25C 5/182; F25C 5/046; F25C 2400/10; F25C 2500/06
(Continued)

(56) References Cited

U.S. PATENT DOCUMENTS 9,341,402 B1 5/2016 Loudermilk et al.
2005/0262866 A1* 12/2005 Seo ..... F25C 5/22 62/340
(Continued)

FOREIGN PATENT DOCUMENTS

AU 2020341603 B2 4/2023
CA 2 618 960 A1 1/2009
(Continued)

OTHER PUBLICATIONS

Extended European Search Report dated Dec. 9, 2022 issued in European Patent Application No. 20861557.5.
(Continued)

*Primary Examiner* — Joel M Attey
(74) *Attorney, Agent, or Firm* — Morgan, Lewis & Bockius LLP

(57) ABSTRACT

A refrigerator is provided. The refrigerator includes a refrigerator body, a door body and an ice making compartment. The refrigerator body includes a storage compartment. The door body is configured to open or close the storage compartment. The ice making compartment is disposed in the storage compartment, and includes an ice making compartment shell, an ice maker, and an ice storage box. The ice maker is configured to make ice cubes. The ice storage box is located below the ice maker, and is configured to store the
(Continued)

ice cubes made by the ice maker. The ice storage box includes a box body and a first ice baffle. At least a part of the first ice baffle is located in the box body, and the first ice baffle is configured to prevent the ice cubes from accumulating at a position of the box body close to the door body.

18 Claims, 18 Drawing Sheets

(30) Foreign Application Priority Data

Sep. 3, 2019 (CN) ..... 201910829087.6
Sep. 3, 2019 (CN) ..... 201921454615.6
Sep. 3, 2019 (CN) ..... 201921454625.X
Sep. 3, 2019 (CN) ..... 201921455414.8

(58) Field of Classification Search
USPC ..... 62/344
See application file for complete search history.

(56) References Cited

U.S. PATENT DOCUMENTS

| | | | | |
|---|---|---|---|---|
| 2006/0065007 | A1 | 3/2006 | Park et al. | |
| 2009/0277210 | A1 | 11/2009 | Eveland et al. | |
| 2011/0126577 | A1* | 6/2011 | An | F25D 23/126 222/129 |
| 2011/0162392 | A1 | 7/2011 | Lim et al. | |
| 2011/0162404 | A1* | 7/2011 | Shin | F25D 23/006 62/340 |
| 2011/0162406 | A1 | 7/2011 | Shin et al. | |
| 2011/0309732 | A1 | 12/2011 | Horil et al. | |
| 2012/0174613 | A1* | 7/2012 | Park | F25C 5/22 62/320 |
| 2013/0167569 | A1 | 7/2013 | Lee | |
| 2013/0263620 | A1 | 10/2013 | An et al. | |
| 2013/0264929 | A1 | 10/2013 | An et al. | |
| 2016/0370049 | A1 | 12/2016 | Yang | |
| 2016/0370052 | A1 | 12/2016 | Yang | |
| 2016/0370086 | A1 | 12/2016 | Lee | |
| 2016/0370096 | A1 | 12/2016 | Yang | |
| 2016/0370097 | A1 | 12/2016 | Yang | |
| 2017/0292746 | A1 | 10/2017 | Yang | |
| 2017/0307270 | A1 | 10/2017 | Kim | |
| 2018/0017310 | A1 | 1/2018 | Jeong et al. | |
| 2018/0164018 | A1 | 6/2018 | Park et al. | |
| 2018/0187942 | A1 | 7/2018 | Hong et al. | |
| 2019/0204001 | A1* | 7/2019 | Scalf | F25C 5/182 |

FOREIGN PATENT DOCUMENTS

| | | | |
|---|---|---|---|
| CN | 101074822 | A | 11/2007 |
| CN | 102095301 | A | 6/2011 |
| CN | 102116562 | A | 7/2011 |
| CN | 102116564 | A | 7/2011 |
| CN | 102116569 | A | 7/2011 |
| CN | 102242997 | A | 11/2011 |
| CN | 102331126 | A | 1/2012 |
| CN | 102589230 | A | 7/2012 |
| CN | 103185431 | A | 7/2013 |
| CN | 103363753 | A | 10/2013 |
| CN | 103363756 | A | 10/2013 |
| CN | 203413910 | U | 1/2014 |
| CN | 106225387 | A | 12/2016 |
| CN | 106257178 | A | 12/2016 |
| CN | 106257215 | A | 12/2016 |
| CN | 205957546 | U | 2/2017 |
| CN | 106568254 | A | 4/2017 |
| CN | 106595172 | A | 4/2017 |
| CN | 106642955 | A | 5/2017 |
| CN | 106839626 | A | 6/2017 |
| CN | 107621106 | A | 1/2018 |
| CN | 108266946 | A | 7/2018 |
| CN | 108286855 | A | 7/2018 |
| CN | 207778905 | U | 8/2018 |
| CN | 109059408 | A | 12/2018 |
| CN | 109373680 | A | 2/2019 |
| CN | 109708344 | A | 5/2019 |
| CN | 109708406 | A | 5/2019 |
| CN | 109716047 | A | 5/2019 |
| CN | 210772966 | U | 6/2020 |
| CN | 211739628 | U | 10/2020 |
| CN | 211739629 | U | 10/2020 |
| EP | 3 062 049 | A1 | 8/2016 |
| KR | 10-2011-0079968 | A | 7/2011 |
| KR | 10-2012-0033536 | A | 4/2012 |
| KR | 10-2017-0121512 | A | 11/2017 |
| WO | 2009/107388 | A1 | 9/2009 |
| WO | 2019/083498 | A1 | 5/2019 |

OTHER PUBLICATIONS

Office Action issued on Mar. 22, 2024 in Chinese Patent Application No. 201910829087.6 with English translation.
Office Action issued on Mar. 22, 2024 in Chinese Patent Application No. 201910829074.9 with English translation.
Office Action issued on Jan. 10, 2024 in Chinese Patent Application No. 201910829072.X with English translation.
Office Action issued on Apr. 4, 2024 in Australian Patent Application No. 2023203620.
Office Action issued on Apr. 10, 2024 in Chinese Patent Application No. 201910829072.X with English translation.
Office Action issued in corresponding Chinese Patent Application No. 202080000881.0 dated Jan. 4, 2022, with English translation.
Office Action issued in corresponding Chinese Patent Application No. 202080000814.9 dated Aug. 26, 2021, with English translation.
International Search Report and Written Opinion issued in corresponding International Application No. PCT/ CN2020/091852 dated Aug. 5, 2020, with English translation.
International Search Report and Written Opinion issued in corresponding International Application No. PCT/ CN2020/093363 dated Aug. 28, 2020, with English translation.
International Search Report and Written Opinion issued in corresponding International Application No. PCT/ CN2020/104808 dated May 20, 2020, with English translation.
Decision of Rejection issued in corresponding Chinese Patent Application No. 202080000881.0 dated Aug. 30, 2022 with English Translation.
Guide for Home Appliances with English Translation.
Australian Office Action issued in corresponding Chinese Patent Application No. 2020341603 dated Sep. 29, 2022.

* cited by examiner

REFRIGERATOR

CROSS-REFERENCE TO RELATED APPLICATIONS

This application is a continuation-in-part application of International Patent Application No. PCT/CN2020/093363, filed on May 29, 2020, which claims priorities to Chinese Patent Application No. 201910829072.X, filed on Sep. 3, 2019, Chinese Patent Application No. 201910829087.6, filed on Sep. 3, 2019, Chinese Patent Application No. 201910829074.9, filed on Sep. 3, 2019, Chinese Patent Application No. 201921454615.6, filed on Sep. 3, 2019, Chinese Patent Application No. 201921455414.8, filed on Sep. 3, 2019, Chinese Patent Application No. 201921454625.X, filed on Sep. 3, 2019, PCT International Patent Application No. PCT/CN2019/104808, filed on Sep. 6, 2019, and PCT International Patent Application No. PCT/CN2020/091852, filed on May 22, 2020, which are incorporated herein by reference in their entireties.

TECHNICAL FIELD

The present disclosure relates to the technical field of household appliances, and in particular, to a refrigerator.

A refrigerator is a household appliance capable of supplying cold air to a freezing compartment and a refrigerating compartment to keep various foods fresh for a long time Foods to be preserved below a freezing temperature, such as meat, fish and ice cream, are stored in the freezing compartment, and foods to be preserved above the freezing temperature, such as vegetables, fruits and beverages, are stored in the refrigerating compartment.

SUMMARY

A refrigerator is provided. The refrigerator includes a refrigerator body, a door body and an ice making compartment. The refrigerator body includes a storage compartment. The door body is configured to open or close the storage compartment. The ice making compartment is disposed in the storage compartment, and includes an ice making compartment shell, an ice maker, and an ice storage box. The ice maker is located in the ice making compartment shell, and is configured to make ice cubes. The ice storage box is located below the ice maker, and is configured to store the ice cubes made by the ice maker. The ice storage box includes a box body and a first ice baffle. At least a part of the first ice baffle is located in the box body, and the first ice baffle is configured to prevent the ice cubes from accumulating at a position of the box body close to the door body.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and actual timings of signals to which the embodiments of the present disclosure relate.

DETAILED DESCRIPTION

Figure 1A:
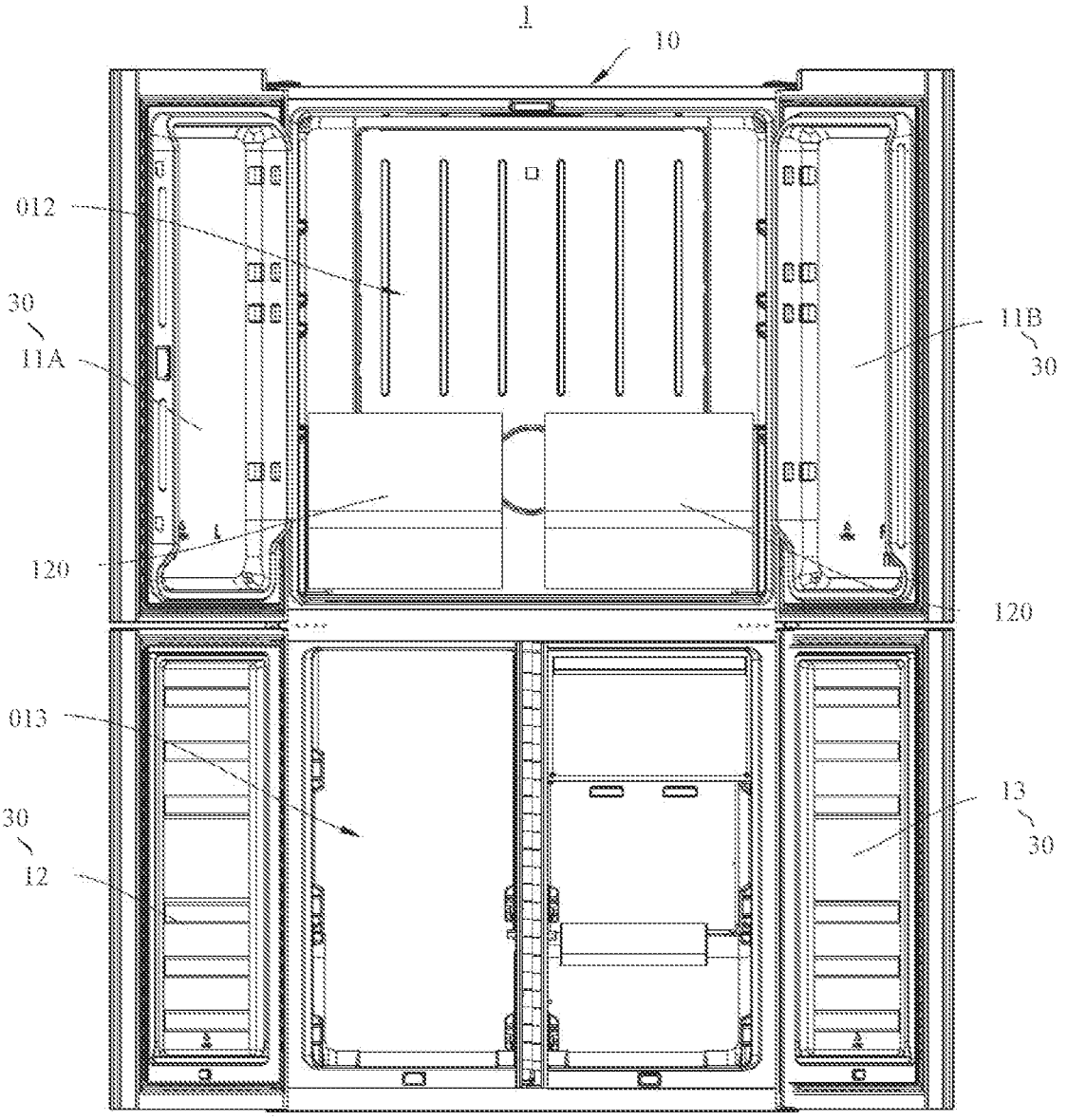
FIG. 1A is a diagram showing a structure of a door body of a refrigerator in an open state, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed in an open and inclusive sense, i.e., "including, but not limited to". In the description, the term such as "one embodiment", "some embodiments", "exemplary embodiments", "example", "specific example" or "some examples" is intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features in the description of the embodiments of the present disclosure, the term "a plurality of" means two or more unless otherwise specified.

In the description of some embodiments, the terms "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C" and they both include the following combinations of A, B and C: only A, only B, only C, a combination of A and 8, a combination of A and C, a combination of B and C, and a combination of A, B and C.

The phrase "A and/or B" includes the following three combinations: only A, only B, and a combination of A and B.

As used herein, the term "if", depending on the context, is optionally construed as "when" or "in a case where" or "in response to determining" or "in response to detecting". Similarly, the phrase "if it is determined" or "if [a stated condition or event] is detected", depending on the context, is optionally construed as "in a case where it is determined" or "in response to determining" or "in a case where [the stated condition or event] is detected" or "in response to detecting [the stated condition or event]".

The use of the phrase "applicable to" or "configured to" herein means an open and inclusive language, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable range of deviation. The acceptable range of deviation is determined by a person of ordinary skill in the art, considering measurement in question and errors associated with measurement of a particular quantity (i.e., limitations of a measurement system). For example, the term "parallel" includes absolute parallelism and approximate parallelism, and an acceptable range of deviation of the approximate parallelism may be, for example, a deviation within 5°; the term "perpendicular" includes absolute perpendicularity and approximate perpendicularity, and an acceptable range of deviation of the approximate perpendicularity may also be, for example, a deviation within 5°, the term "equal" includes absolute equality and approximate equality, and an acceptable range of deviation of the approximate equality may be, for example, a difference between two equals of less than or equal to 5% of either of the two equals.

A side of a refrigerator 1 facing a user during use is defined as a front side, and a side opposite to the front side is defined as a rear side.

Figure 1B:
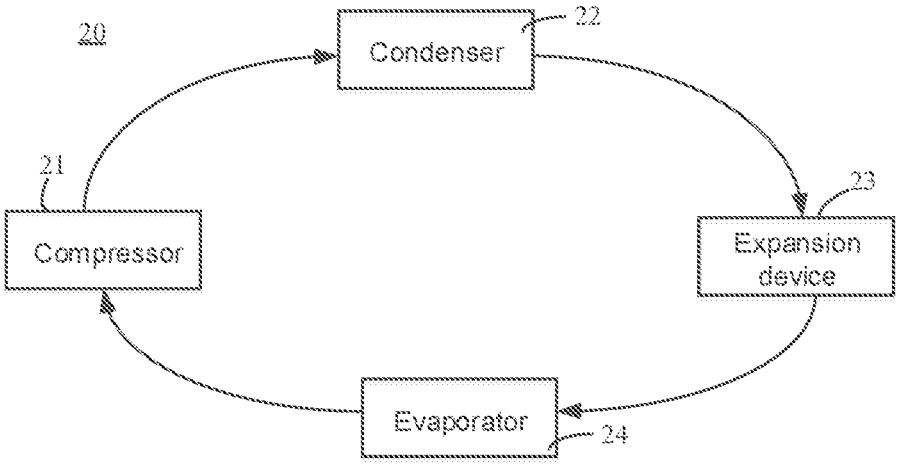
FIG. 1B is a schematic diagram of a cold air supply device of a refrigerator, in accordance with some embodiments.

In some embodiments, referring to FIGS. 1A and 1B, the refrigerator 1 includes a refrigerator body 10, a cold air supply device 20 and a door body 30. The refrigerator body 10 includes a storage compartment, the cold air supply device 20 is configured to cool the storage compartment, and the door body 30 is configured to open and close the storage compartment.

The cold air supply device 20 cools the storage compartment by performing heat exchange with an outside of the refrigerator body 10. As shown in FIG. 1B, the cold air supply device 20 includes a compressor 21, a condenser 22, an expansion device 23 and an evaporator 24, and a refrigerant circulates in a sequence of the compressor 21, the condenser 22, the expansion device 23, the evaporator 24 and the compressor 21 to cool the storage compartment.

For example, the evaporator 24 may be arranged to be in contact with an outer wall of the storage compartment to directly cool the storage compartment, in some embodiments, the cold air supply device 20 may further include a circulation fan to circulate air in the storage compartment through the evaporator 24 and the circulation fan.

The door body 30 is pivotally connected with the refrigerator body 10 to rotatably open or close the storage compartment. For example, the door body 30 may be hinged to a front end of the refrigerator body 10.

Figure 3:
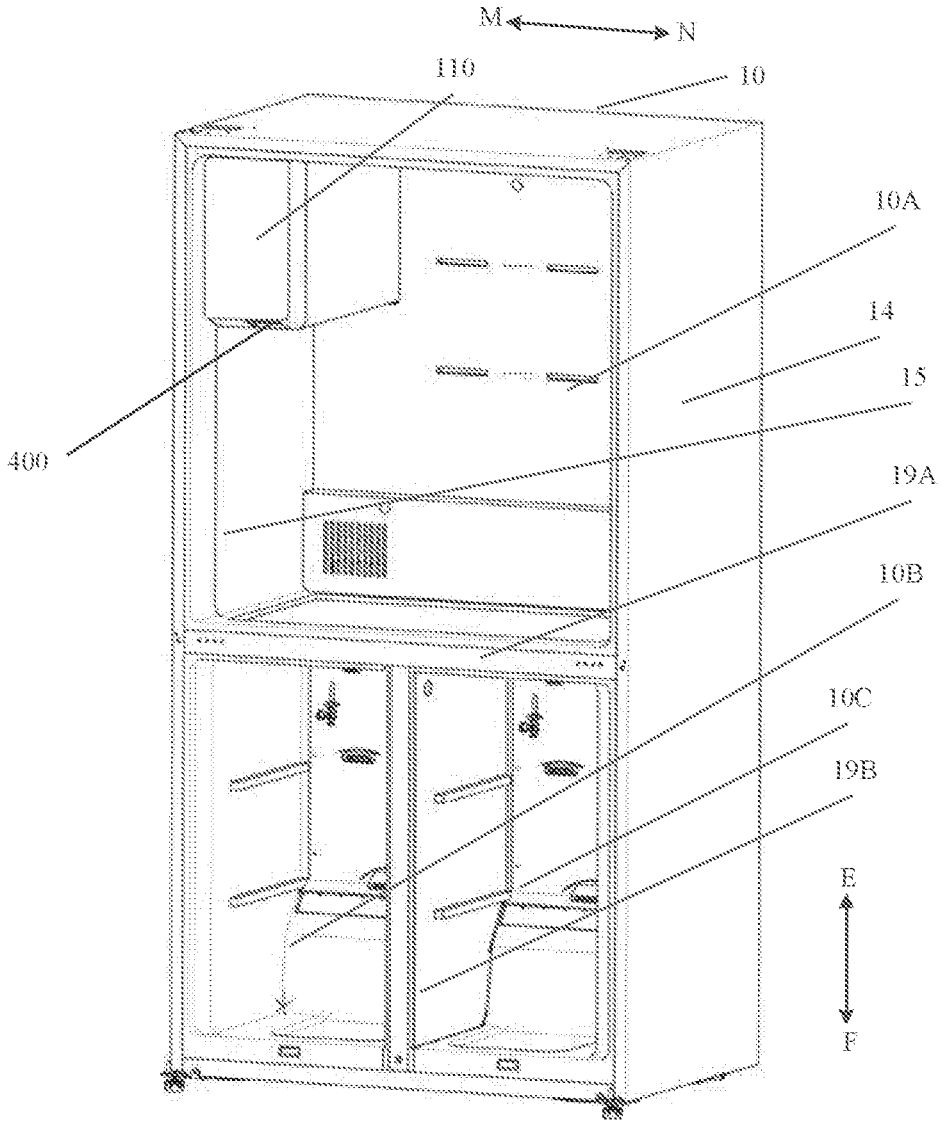
FIG. 3 is a diagram showing a structure of a refrigerator with a door body removed, in accordance with some embodiments.

In some embodiments, as shown in FIGS. 1A and 3, the storage compartment Includes a refrigerating compartment 10A for refrigerating foods, a freezing compartment 10B for freezing foods, and a variable temperature compartment 10C (i.e., an adjustable temperature control compartment). The refrigerator 1 includes a first partition 19A and a second partition 19B, and the first partition 19A and the second partition 19B are substantially perpendicular. At least one of the first partition 19A or the second partition 19B may include a heat insulation material.

For example, the first partition 19A is provided at a middle position of the refrigerator body 10 in a height direction. The first partition 19A may extend in a width direction of the refrigerator 1, and the second partition 19B may extend in the height direction of the refrigerator 1. For the width direction, reference may be made to the MN direction in FIG. 3, and for the height direction, reference may be made to the EF direction in FIG. 3. The storage compartment is partitioned into an upper storage compartment 012 and a lower storage compartment 013 by the first partition 19A (referring to FIG. 1A). The second partition 19B may partition the lower storage compartment 013 into the freezing compartment 108 and the variable temperature compartment 10C (referring to FIG. 3).

Figure 1C:
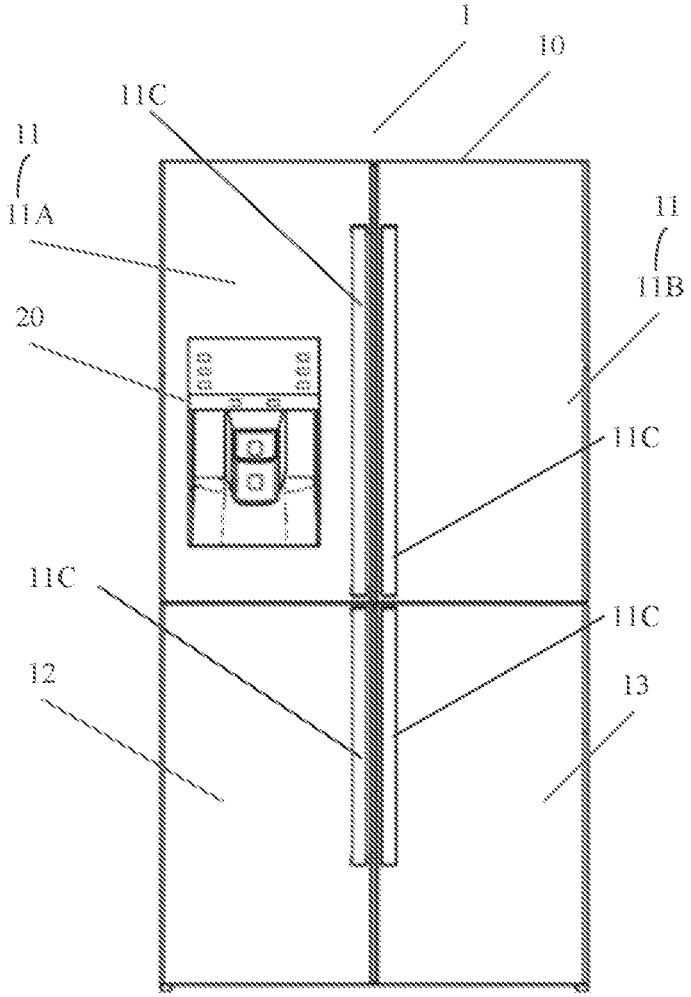
FIG. 1C is a diagram showing a structure of a door body of a refrigerator in a closed state, in accordance with some embodiments.

In some embodiments, the upper storage compartment 012 serves as the refrigerating compartment for storing foods in a refrigerating mode, and the lower storage compartment 013 serves as the freezing compartment for storing foods in a freezing mode, and the variable temperature compartment for adjusting temperature. In some embodiments, as shown in FIGS. 1A and 1C, the refrigerator 1 includes four door bodies 30. The door body 30 includes a refrigerating compartment door 11, a freezing compartment door 12, and a variable temperature compartment door 13.

The refrigerating compartment door 11 may include a first refrigerating compartment door 11A and a second refrigerating compartment door 11B. The first refrigerating compartment door 11A may be disposed on a left side of the refrigerating compartment 10A, and the second refrigerating compartment door 11B may be disposed on a right side of the refrigerating compartment 10A. When the refrigerating compartment 10A needs to be opened, the first refrigerating compartment door 11A and the second refrigerating compartment door 11B are pivoted in directions away from each other; when the refrigerating compartment 10A needs to be closed, the first refrigerating compartment door 11A and the second refrigerating compartment door 11B are pivoted in directions close to each other.

The freezing compartment door 12 is configured to open or close the freezing compartment 10B. The variable temperature compartment door 13 is configured to open or close the variable temperature compartment 10C.

As shown in FIG. 1C, at least one of the refrigerating compartment door 11, the freezing compartment door 12, or the variable temperature compartment door 13 may further include a handle 11C, so that operation of the user is convenient through the handle 11C. Four handles 11C are shown in FIG. 1C.

In addition, referring to FIG. 1A, the refrigerator 1 may further include an ice maker 120, so that the refrigerator 1 has an ice making function, and ice cubes or ice water may be provided to the user by the ice maker 120. It will be noted that, the ice maker 120 is not limited to a lower portion of the refrigerating compartment 10A shown in FIG. 1A. In some embodiments, the ice maker 120 may also be located at an upper portion of the refrigerating compartment 10A.

Figure 2:
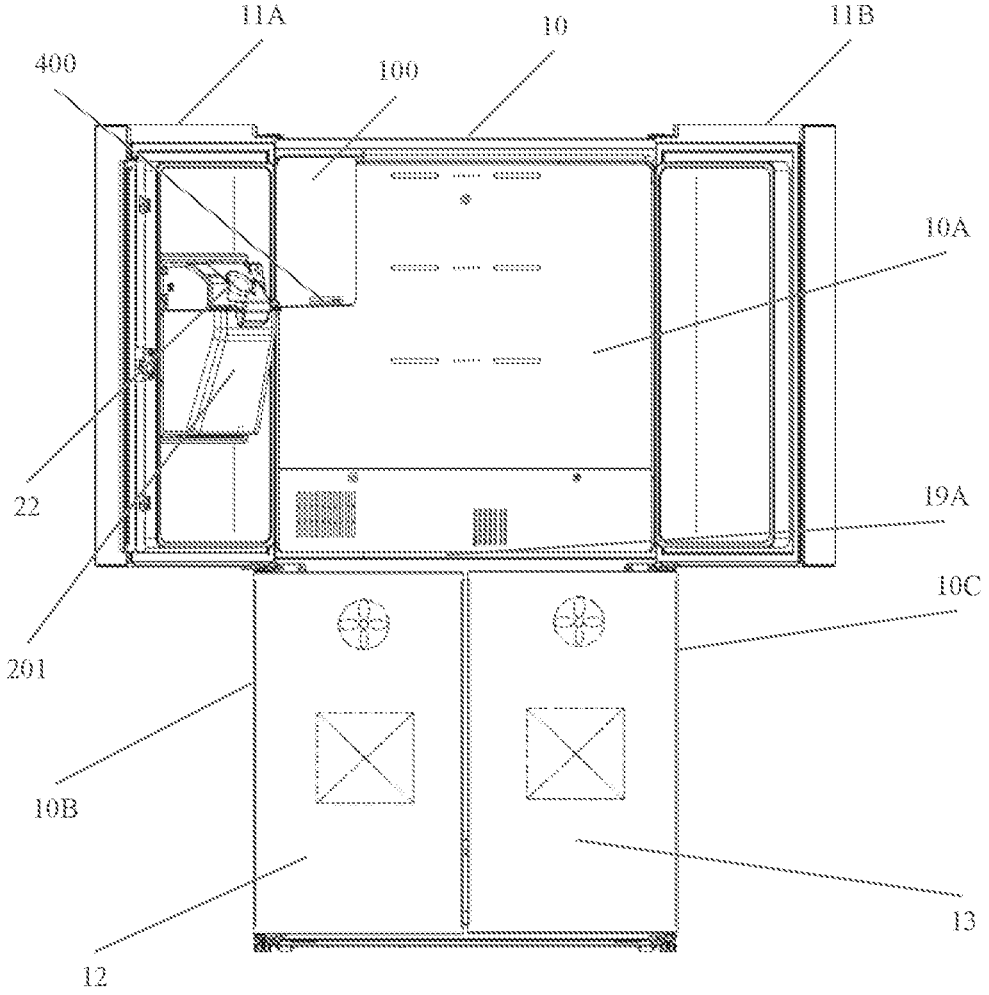
FIG. 2 is a diagram showing a structure of a refrigerating compartment door of a refrigerator in an open state, in accordance with some embodiments.

For example, as shown in FIGS. 2 and 3, the refrigerator 1 includes an ice making compartment 100, which is provided in the refrigerating compartment 10A, and may be separated from other space of the refrigerating compartment 10A. The ice making compartment 100 is located at an upper portion of at least one of a left side or a right side of the refrigerating compartment 10A. The ice making compartment 100 includes an ice making compartment shell 110, and the ice making compartment 100 may be separated from other space of the refrigerating compartment 10A through the ice making compartment shell 110. The ice maker 120 is located in the ice making compartment 100.

Figure 4A:
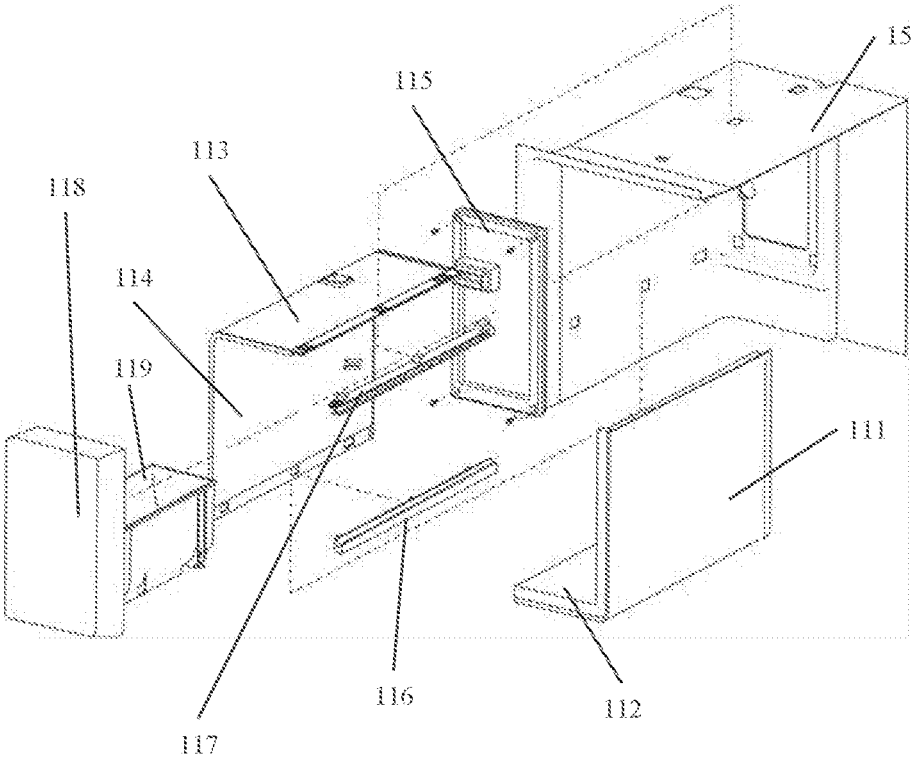
FIG. 4A is an exploded view of an ice making compartment shell of a refrigerator in accordance with some embodiments.
Figure 4B:
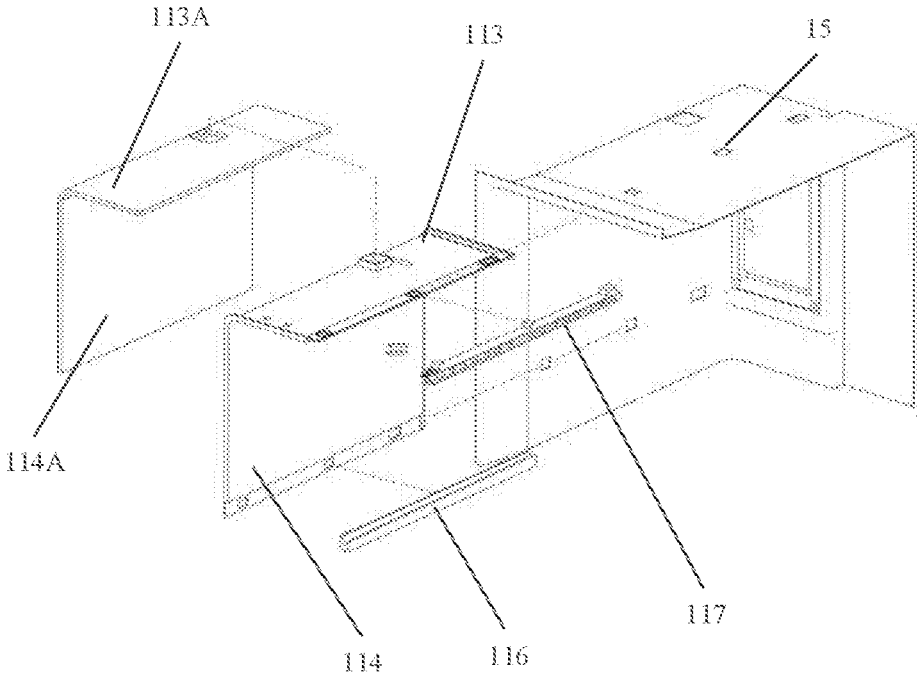
FIG. 4B is an exploded view of a local structure of an ice making compartment shell of a refrigerator in accordance with some embodiments.

As shown in FIGS. 4A and 4B the ice making compartment shell 110 includes a lower sidewall 112, a right sidewall 111, an upper sidewall 113 and a left sidewall 114. The refrigerating compartment 10A includes an inner container 15 of the refrigerating compartment, which includes an upper wall, a left wall, a right wall, and a rear wall. The upper sidewall 113 is arranged close to the upper wall, and a first heat insulation pad 113A is provided between the upper sidewall 113 and the upper wall to improve heat insulation performance between the ice making compartment 100 and the refrigerating compartment 10A, and the first heat insulation pad 113A may be adhered to the upper sidewall 113.

In some embodiments, the ice making compartment shell 110 is provided at an upper left corner of the refrigerating compartment 10A, the left sidewall 114 of the ice making compartment shell 110 is arranged close to the left wall of the inner container 15 of the refrigerating compartment, and a second heat insulation pad 114A is provided between the left sidewall 114 and the left wall (as shown in FIG. 4B), so as to improve the heat insulation performance between the ice making compartment 100 and the refrigerating compartment 10A, and the second heat insulation pad 114A may be adhered to the left sidewall 114.

Figure 4C:
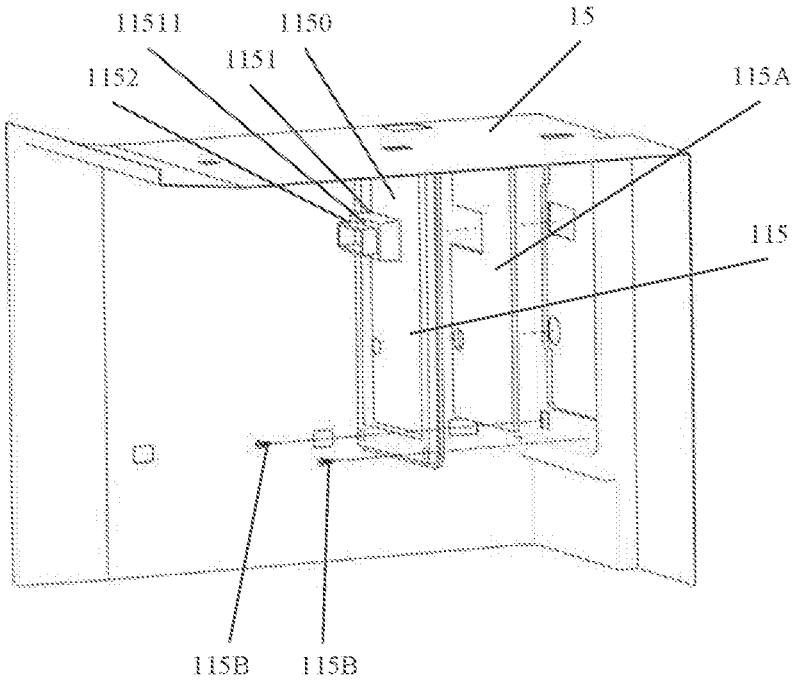
FIG. 4C is an exploded view of a rear sidewall of an ice making compartment of a refrigerator, in accordance with some embodiments.
Figure 4D:
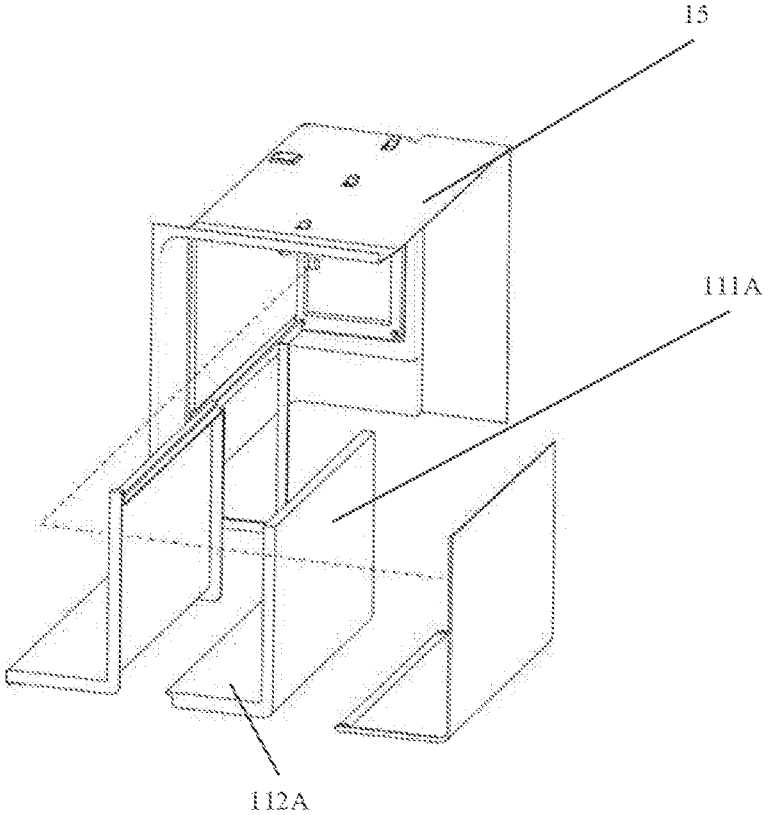
FIG. 4D is a diagram showing a structure of an integral member of a right sidewall and a lower sidewall of an ice making compartment of a refrigerator, in accordance with some embodiments.
Figure 4E:
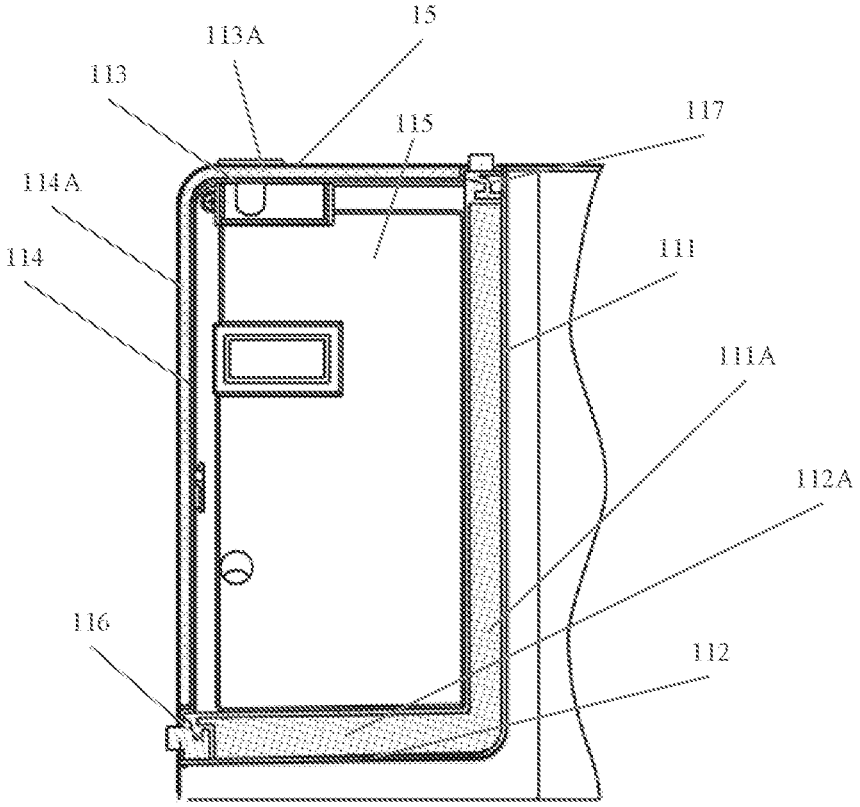
FIG. 4E is a cross-sectional view of an ice making compartment shell of a refrigerator, in accordance with some embodiments.

In some embodiments, as shown in FIG. 4E, the upper sidewall 113 and the left sidewall 114 of the ice making compartment shell 110 are of an integral member, and the right sidewall 111 and the lower sidewall 112 of the ice making compartment shell 110 are of an integral member. An overall thickness of the right sidewall 111 and the lower sidewall 112 is greater than an overall thickness of the upper sidewall 113 and the left sidewall 114. As shown in FIGS. 4D and 4E, the lower sidewall 112 and the right sidewall 111 are filled with heat insulation materials 112A and 111A.

As shown in FIG. 4E, the ice making compartment 100 includes a first connecting rail 116 and a second connecting rail 117. The first connecting rail 116 is connected with the lower sidewall 112, so as to connect the lower sidewall 112 with the inner container 15 of the refrigerating compartment, and the second connecting rail 117 is connected with the right sidewalk 111, so as to connect the right sidewall 111 with the inner container 15 of the refrigerating compartment. The first connecting rail 116 may further connect the left sidewall 114 with the lower sidewall 112, so as to connect the left sidewall 114 with the inner container 15 of the refrigerating compartment, and the second connecting rail 117 may further connect the upper sidewall 113 with the right sidewall 111, so as to connect the upper sidewalk 113 with the inner container 15 of the refrigerating compartment.

For example, a lower left portion of the integral member formed by the upper sidewall 113 and the left sidewall 114 is fixed on the left wall of the inner container 15 of the refrigerating compartment through the first connecting rail 116; an upper right portion of the integral member formed by the upper sidewall 113 and left sidewall 114 is fixed on the upper wall of the inner container 15 of the refrigerating compartment.

In some embodiments, the ice making compartment 100 may also be provided at an upper right corner of the refrigerating compartment 10A. The right sidewall 111 of the ice making compartment shell 110 is arranged close to the right wall of the inner container 15 of the refrigerating compartment, and a third heat insulation pad is provided between the right sidewall 111 and the right wall, so as to improve the heat insulation performance between the ice making compartment 100 and the refrigerating compartment 10A.

In a case where the ice making compartment 100 is provided at the upper right corner of the refrigerating compartment 10A, the upper sidewall 113 and the right sidewall 111 of the ice making compartment shell 110 are of an integral member and the lower sidewall 112 and the left sidewall 114 of the ice making compartment shell 110 are of an integral member. An overall thickness of the left sidewall 114 and the lower sidewall 112 is greater than an overall thickness of the upper sidewall 113 and the right sidewall 111.

In the case where the ice making compartment 100 is provided at the upper right corner of the refrigerating compartment 10A, the ice making compartment 100 includes a third connecting rail and a fourth connecting rail. The third connecting rail is connected with the lower sidewall 112, so as to connect the lower sidewall 112 with the inner container 15 of the refrigerating compartment, and the fourth connecting rail is connected with the left sidewall 114, so as to connect the left sidewall 114 with the inner container 15 of the refrigerating compartment. The third connecting rail may also connect the right sidewall 111 with the lower sidewall 112, so as to connect the right sidewall 111 with the inner container 15 of the refrigerating compartment. The fourth connecting rail may also connect the upper sidewall 113 with the left sidewall 114, so as to connect the upper sidewall 113 with the inner container 15 of the refrigerating compartment.

It will be noted that, the third connecting rail and the fourth connecting rail may have structures similar to those of the first connecting rail 116 and the second connecting rail 117, and details will not be repeated herein.

In some embodiments, as shown in FIG. 4C, the ice making compartment shell 110 further includes a rear sidewall 115 arranged close to the rear wall of the inner container 15 of the refrigerating compartment. A rear heat insulation pad 115A is provided between the rear sidewall 115 and the rear wall to improve the heat insulation performance between the ice making compartment 100 and the refrigerating compartment 10A.

In some embodiments, at least one of the first heat insulation pad 113A, the second heat insulation pad 114A, the third heat insulation pad or the rear heat insulation pad 115A includes a heat insulation foam.

For ease of description, some embodiments of the present disclosure are mainly described by taking an example in which the ice making compartment 100 is located at the upper left corner of the refrigerating compartment 10A. However, this should not be construed as a limitation on the present disclosure.

In some embodiments, an installation process of the ice making compartment shell 110 includes the following steps. The rear sidewall 115 is first installed on the inner container 15 of the refrigerating compartment, and then the integral member of the left sidewall 114 and the upper sidewall 113 is installed on the inner container 15 of the refrigerating compartment. After the installation is accomplished, the refrigerator body 1 is foamed.

The right sidewall 111 and the lower sidewall 112 are formed in a separately foamed manner After the foaming of the refrigerator body 1 and the foaming of the right sidewall 111 and the lower sidewall 112 are accomplished, the integral member of the right sidewall 111 and the lower sidewall 112 is installed on the refrigerator body.

For example, as shown in FIG. 4C, the rear sidewall 115 is installed on the inner container 15 of the refrigerating compartment by means of self-tapping screws 1158. During the installation, the rear heat insulation pad 115A is provided between the rear sidewall 115 and the rear wall of the inner container 15 of the refrigerating compartment.

After the foaming of the integral member of the right sidewall 111 and the lower sidewall 112 is accomplished, the integral member is snapped into the first connecting rail 116 and the second connecting rail 117. The right sidewall 111 is snapped into the second connecting rail 117, and the lower sidewall 112 is snapped into the first connecting rail 116.

After the installation is accomplished, the right sidewall 111, the lower sidewall 112, the upper sidewall 113, the left sidewall 114 and the rear sidewall 115 of the ice making compartment shell 110 enclose an ice making compartment 100 with a front opening in the refrigerating compartment 10A.

In some embodiments, as shown in FIG. 4A, the ice making compartment shell 110 further includes a front sidewalk 118 configured to open or close the front opening of the ice making compartment 100.

Figure 13:
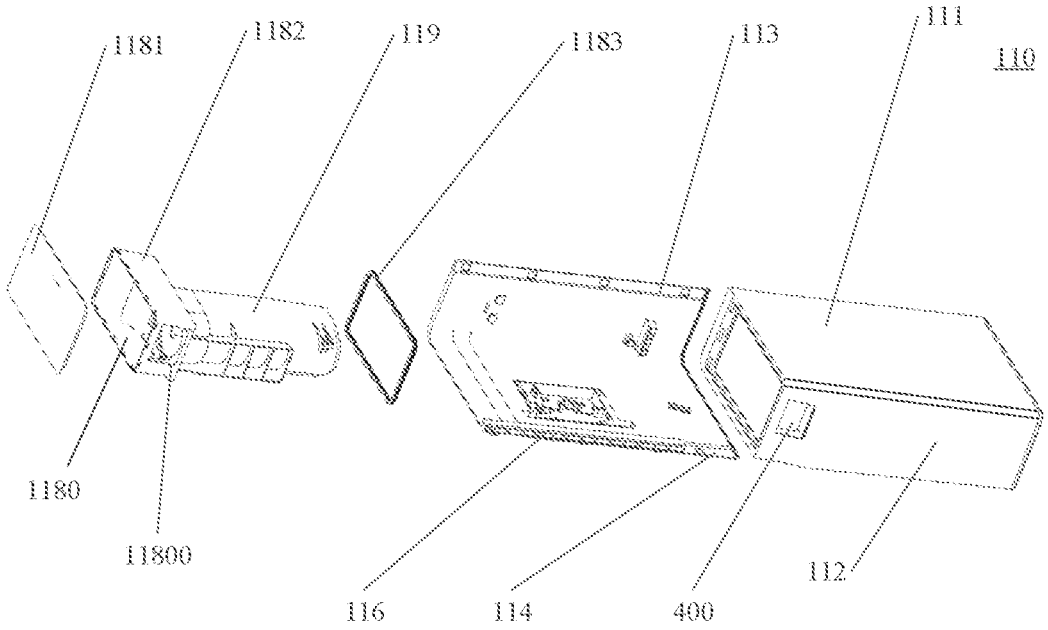
FIG. 13 is an exploded view of an ice making compartment of a refrigerator in accordance with some embodiments.

In order to well seal the ice making compartment 100, at least one of the front sidewall 118 or the front opening of the ice making compartment 100 is provided with a sealing member and the sealing member may be a sealing loop 1183 (referring to FIG. 13). In some embodiments, the sealing loop 1183 is disposed on an inner side or a front side of the right sidewall 111, the lower sidewall 112, the upper sidewall 113, the left sidewall 114, and the rear sidewall 115. In some embodiments, the sealing loop 1183 is disposed on a periphery of a rear shell 1182 of the front sidewall 118.

As shown in FIG. 3, the refrigerator body 10 further includes a shell 14, a heat insulation material between the shell 14 and the inner container 15 of the refrigerating compartment, a heat insulation material between the shell 14 and an inner container of the freezing compartment, and a heat insulation material between the shell 14 and an inner container of the variable temperature compartment. The shell 14 is connected with the inner container 15 of the refrigerating compartment, the inner container of the freezing compartment, and the inner container of the variable temperature compartment, and is located outside the inner container 15 of the refrigerating compartment, the inner container of the freezing compartment, and the inner container of the variable temperature compartment. The inner container 15 of the refrigerating compartment defines the refrigerating compartment 10A, the inner container of the freezing compartment defines the freezing compartment 10B, and the inner container of the variable temperature compartment defines the variable temperature compartment 10C.

In some embodiments, as shown in FIG. 2, the refrigerating compartment door 11 (e.g., the refrigerating compartment door 11A) includes a dispenser 201, through which the user may take out the ice cubes from an outside without opening the refrigerating compartment door 11. The dispenser 201 may include an ice inlet 22, through which the ice cubes made by the ice maker 120 may be discharged into the dispenser 201. The dispenser 201 may further include an ice discharge passage configured to discharge the ice cubes entering the dispenser 201 through the ice inlet 22 to the outside of the refrigerating compartment door 11.

In some embodiments, the ice making compartment 100 performs cooling in a direct cooling manner. That is, the ice maker 120 includes a refrigerant pipe 131 (referring to FIG. 5). The refrigerant discharged from the compressor 21 may flow through the refrigerant pipe 131 in the ice making compartment 100 for refrigerating the ice making compartment 100. The refrigerant discharged from the compressor 21 flows through the condenser 22 to dissipate heat and then flows through the refrigerant pipe 131. The refrigerant absorbs heat in the refrigerant pipe 131, and then flows back to the compressor 21 for compression and recirculation.

Figure 5:
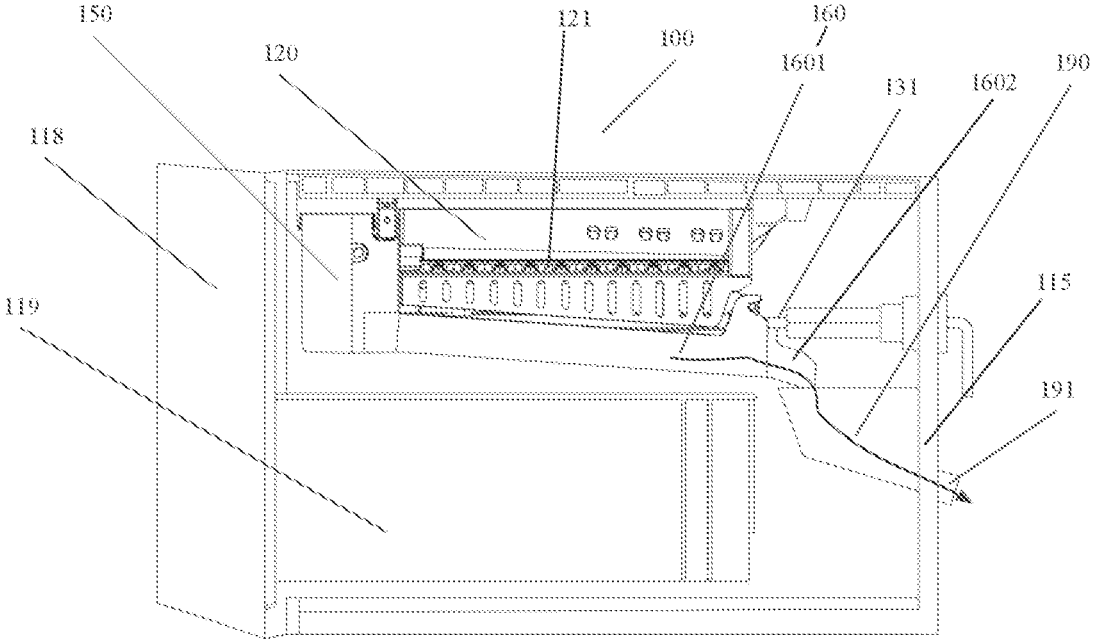
FIG. 5 is a diagram showing an Internal structure of an ice making compartment of a refrigerator, in accordance with some embodiments.
Figure 6:
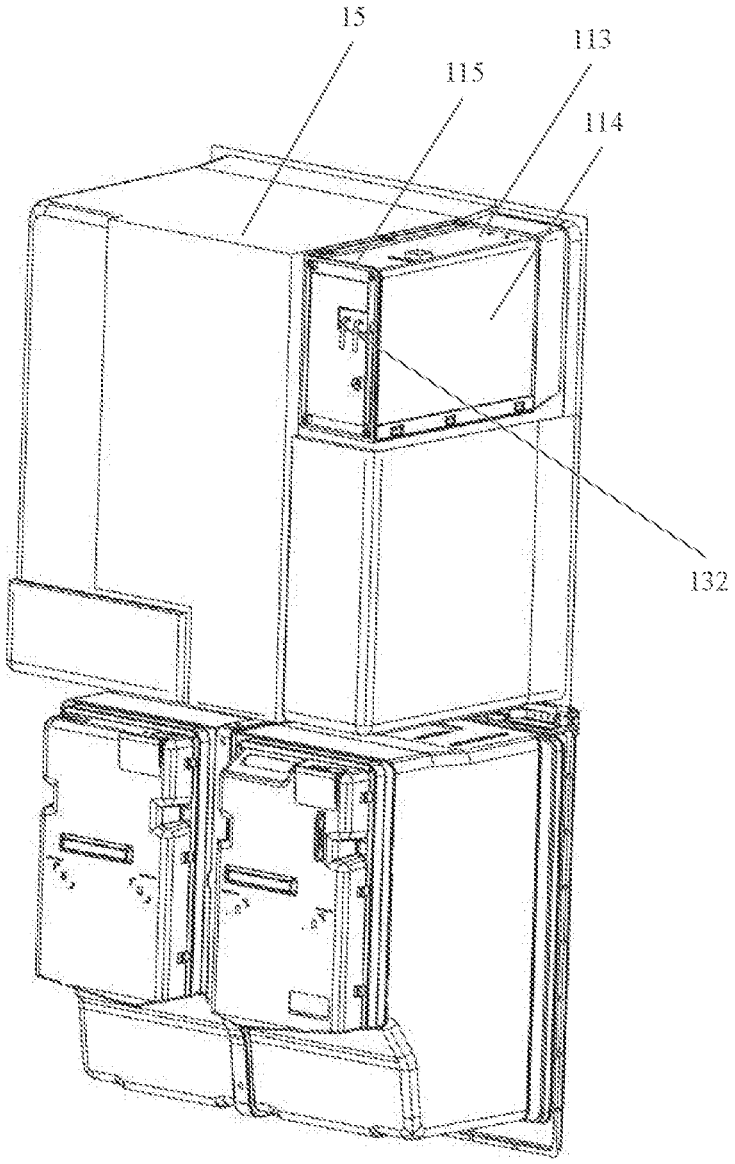
FIG. 6 is a diagram showing an external structure of an ice making compartment of a refrigerator, in accordance with some embodiments.

In some embodiments, as shown in FIG. 4A, the ice making compartment 100 further includes an ice storage box 119 connected with the front sidewall 118 of the ice making compartment shell 110, and the ice storage box 119 is located on a side of the front sidewall 118 close to the rear sidewall 115. As shown in FIG. 5, the ice making compartment 100 includes the ice maker 120. When the front sidewall 118 closes the front opening of the ice making compartment 100, the see storage box 119 is located in the ice making compartment 100, and is configured to store the ice cubes made by the ice maker 120. When the front sidewall 118 opens the front opening of the ice making compartment 100, the ice storage box 119 may move to an outside of the ice making compartment 100 along with the front sidewall 118.

In some embodiments, the ice maker 120 is disposed on the upper sidewall 113 of the ice making compartment shell 110. The ice storage box 119 may be located below the ice maker 120. That is, in the ice making compartment 100, the ice maker 120 is located above the ice storage box 119. After the ice maker 120 accomplishes making ice, the ice cubes may be discharged into the ice storage box 119.

As shown in FIGS. 2, 3 and 13, the ice making compartment shell 110 further includes an ice outlet 400, and the ice outlet 400 is connected with the ice storage box 119 (referring to FIG. 5). When the refrigerating compartment door 11 is closed, the ice outlet 400 may be connected with the ice inlet 22 of the dispenser 201. Therefore, the ice cubes stored in the ice storage box 119 may enter the dispenser 201 through the ice outlet 400 and then through the ice inlet 22, and then be discharged through the ice discharge passage in the dispenser 201. In this way, when the refrigerating compartment door 11 is in a closed state, the ice cubes in the ice making compartment 100 may still be discharged through the dispenser 201 on the refrigerating compartment door 11.

In some embodiments, at least one of the front sidewall 118 or the lower sidewall 112 of the ice making compartment shell 110 includes the ice outlet 400. For example, the front sidewall 118 of the ice making compartment shell 110 includes the ice outlet 400. Alternatively, the lower sidewall 112 of the ice making compartment shell 110 includes the ice outlet 400.

As shown in FIG. 13, the lower sidewall 112 of the ice making compartment shell 110 includes the ice outlet 400. The front sidewall 118 includes a front shell 1181 and the rear shell 1182, and the ice storage box 119 is connected with the rear shell 1182. The ice making compartment 100 further includes an ice crushing compartment 1180 located between the front shell 1181 and the rear shell 1182. The ice crushing compartment 1180 is connected with the ice storage box 119, is located on a side of the see storage box 119 close to the door body 30, and is configured to crush the ice cubes. The ice crushing compartment 1180 includes an ice discharge opening 11800. When the front sidewalk 118 closes the ice making compartment 100, the ice discharge opening 11800 is opposite to the ice outlet 400.

Figure 11:
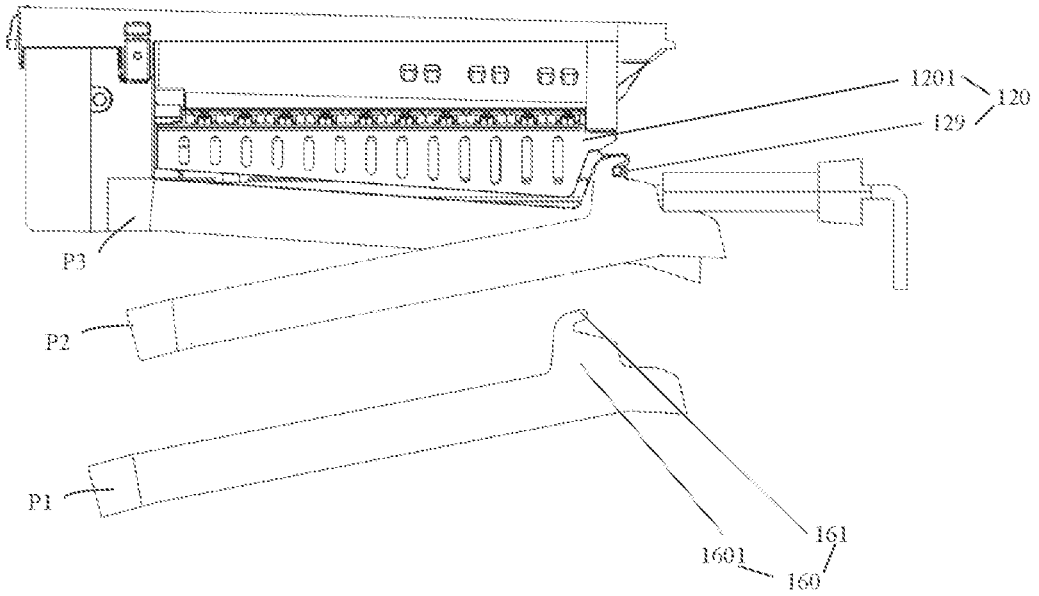
FIG. 11 is a schematic diagram showing an installation process of a water tray in an ice making compartment of a refrigerator, in accordance with some embodiments.
Figure 12:
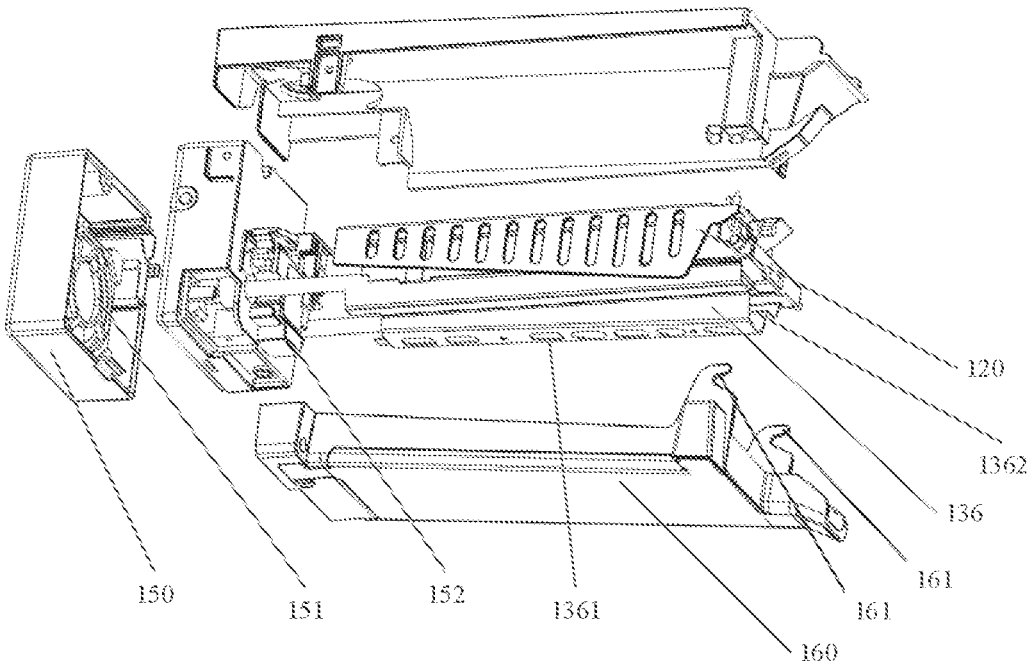
FIG. 12 is a diagram showing a structure related to installation of a fan in an ice making compartment of a refrigerator, in accordance with some embodiments.

In order to well discharge water drops dripping during an ice making process of the ice maker 120, in some embodiments, as shown in FIGS. 5, 11 and 12, the ice making compartment 100 further includes a water tray assembly, which includes a water tray 160 located below the ice maker 120. The water tray 160 is configured to receive the water drops dripping during the ice making process of the ice maker 120, so as to prevent the ice cubes in the ice storage box 119 from being frozen and stuck, or being partially melted due to heat exchange with the water drops, due to that the water drops directly enters the ice storage box 119.

In some embodiments, the water tray 160 is fixed to the ice maker 120, and a rear end of the water tray 160 is inclined downward. For example, the water tray 160 is connected to the ice maker 120.

As shown in FIG. 11, the ice maker 120 includes an ice maker body 1201 and a clamping shaft 129, and the clamping shaft 129 is located at an end (e.g., a rear end) of the ice maker body 1201 away from the door body 30, the water tray 160 includes a water tray body 1601 and a clamping hook matched with the clamping shaft 129, and the clamping hook 161 is located at an end (e.g., a rear end) of the water tray body 1601 away from the door body 30. FIG. 11 shows an installation process of the water tray 160. When the water tray 160 is installed, the clamping hook 161 may be clamped to the clamping shaft 129 (e.g., the water tray body 1601 is assembled at a P2 position from a P1 position), and then an end (e.g., a front end) of the water tray body 1601 close to the door body 30 is lifted upward to fix the front end of the water tray body 1601 to a front end of the ice maker body 1201 (e.g., the water tray body 1601 is assembled at a P3 position from the P2 position). For example, the end (e.g., the front end) of the water tray body 1601 close to the door body 30 may be fixed to the front end of the ice maker 120 by means of a fastener (e.g., a screw). After the installation is accomplished, the front end of the water tray body 1601 is higher than the rear end of the water tray body 1601.

In some embodiments, as shown in FIG. 5, the water tray assembly further includes a water funnel 190, which is located below the rear end of the water tray body 1601, and is disposed on the rear sidewall 115 of the ice making compartment shell 110. Therefore, the water dripping into the water tray 160 flows backward into the water funnel 190, and then is further discharged.

In some embodiments, the water tray 160 further includes a flow guide opening 1602 located at a rear portion of the water tray body 1601. The water funnel 190 is located below the flow guide opening 1601 and behind the ice storage box 119.

The water funnel 190 includes a funnel drain pipe 191 located on a side of the water funnel 190 away from the flow guide opening 1602.

The inner container 15 of the refrigerating compartment further includes a water guide pipe. At least a part of the water guide pipe is located in the heat insulation material between the inner container 15 of the refrigerating compartment and the shell 14, and the funnel drain pipe 191 is connected with the water guide pipe. For example, the funnel drain pipe 191 passes through the rear sidewall 115 and the inner container 15 of the refrigerating compartment to be connected with the water guide pipe. The refrigerator 1 further includes a water storage tray, and the water flowing into the water funnel 190 may pass through the funnel drain pipe 191 and the water guide pipe, and finally flows into the water storage tray. The water in the water storage tray may be heated and evaporated by means of the condenser 22 or an electric heater. A flow direction of the water in the water tray 160 is shown by the dashed line in FIG. 5.

As shown in FIG. 5, the ice maker 120 includes an ice tray 121, in order to achieve rapid ice making of the ice maker 120, the ice maker 120 further includes the refrigerant pipe 131 located below the ice tray 121, and the water funnel 190 is located below the refrigerant pipe 131. The refrigerant pipe 131 is in contact with the ice tray 121.

Figure 7:
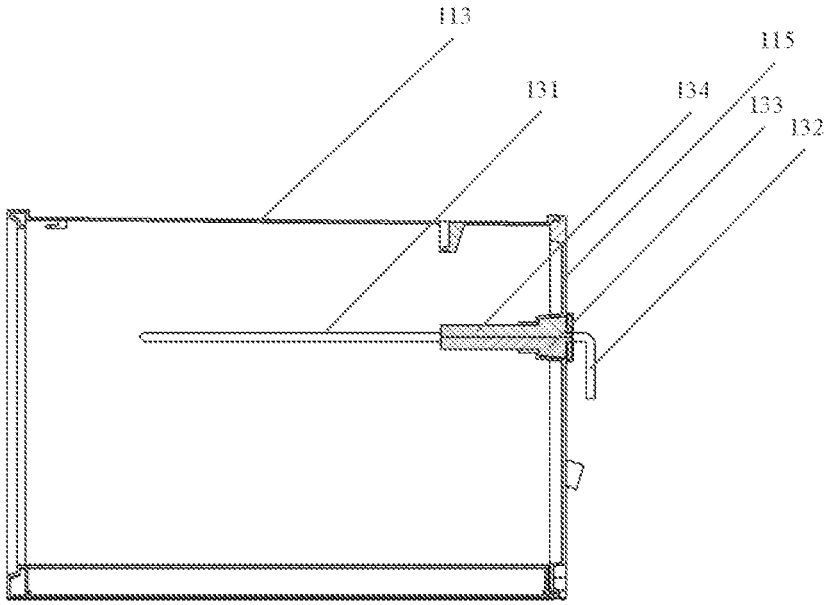
FIG. 7 is a cross-sectional view of a refrigerant pipe of an ice making compartment of a refrigerator in a fixed state: in accordance with some embodiments.
Figure 8:
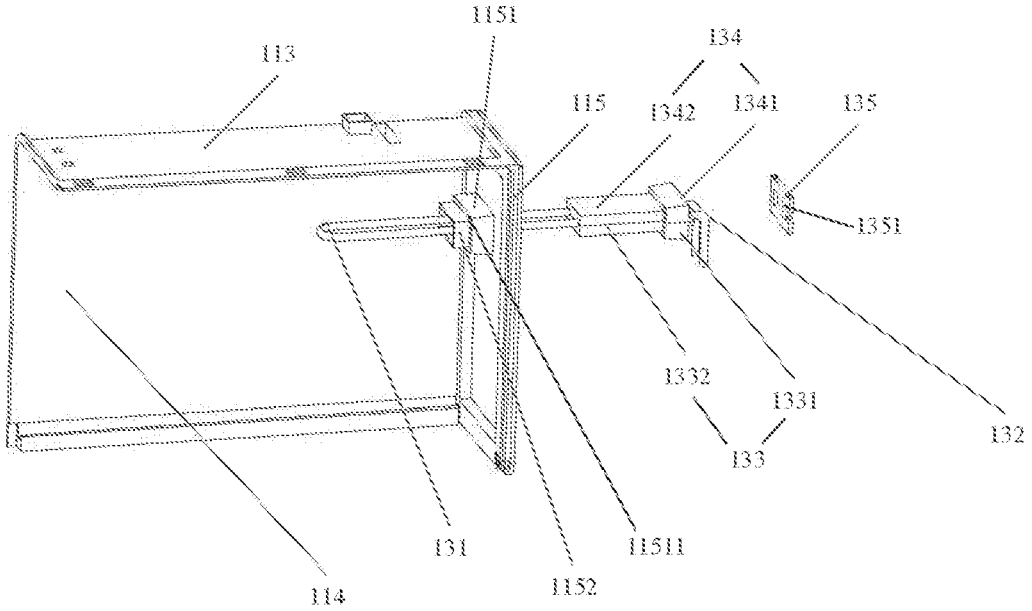
FIG. 8 is an exploded view of a fixed structure of a refrigerant pipe of an see making compartment of a refrigerator, in accordance with some embodiments.
Figure 9:
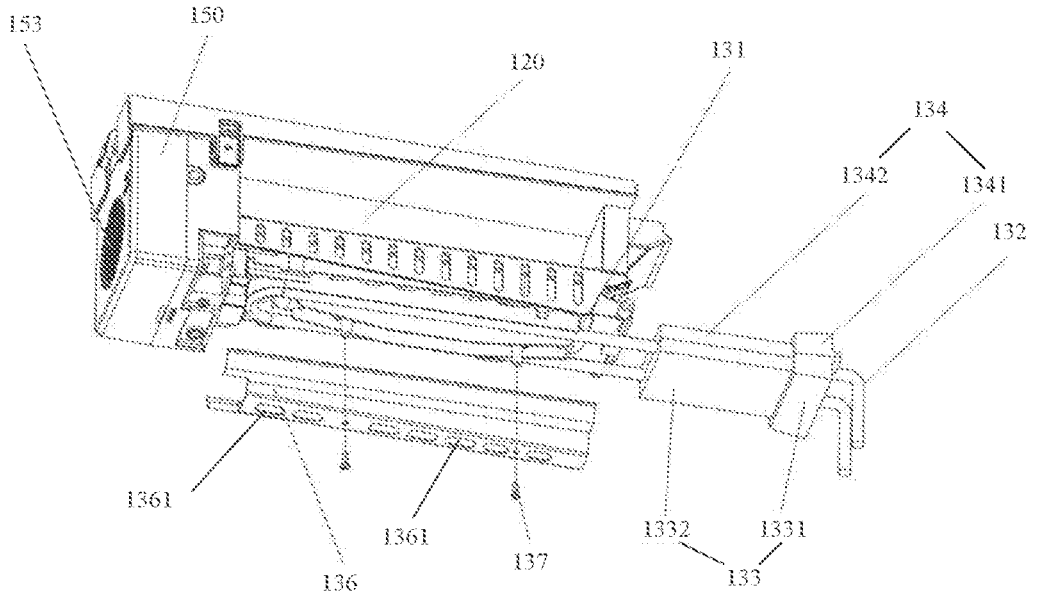
FIG. 9 is a schematic diagram showing assembly of a refrigerant pipe and an ice maker in an ice making compartment of a refrigerator, in accordance with some embodiments.
Figure 10:
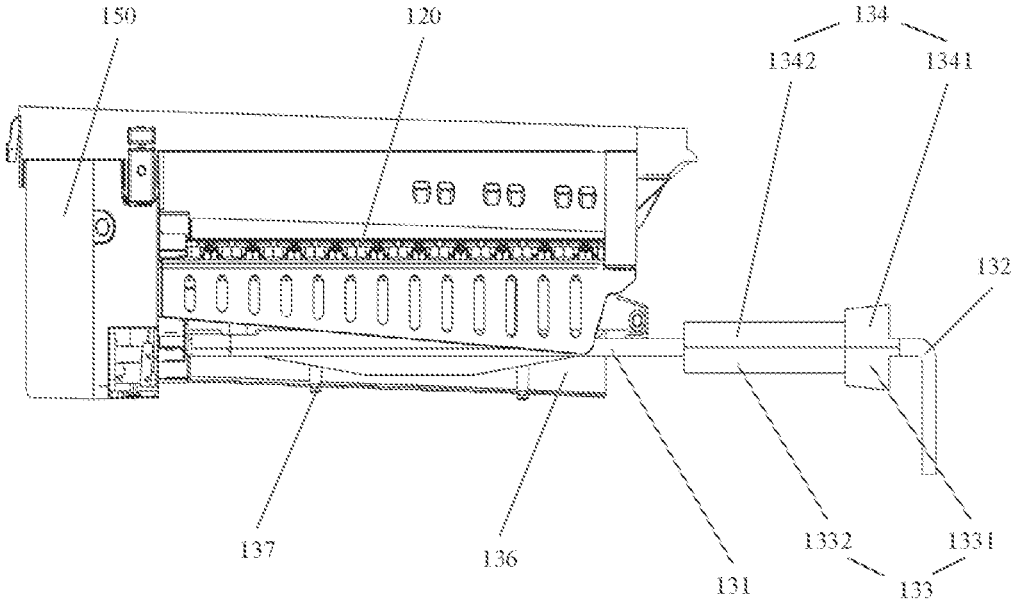
FIG. 10 is a side view of a refrigerant pipe and an ice maker in an see making compartment of a refrigerator after they are assembled, in accordance with some embodiments.

In some embodiments, as shown in FIGS. 7, 8 and 9, the refrigerant pipe 131 further includes an extension section 132, which is a section of the refrigerant pipe 131 outside the ice making compartment 100. The extension section 132 is connected with the cold air supply device 20.

In some embodiments, the refrigerant pipe 131 may be in direct contact with a bottom of the ice tray 121. In some embodiments, a heat conductive material member is further provided between the refrigerant pipe 131 and the ice tray 121, and the refrigerant pipe 131 may be in contact with the ice tray 121 through the heat conductive material member.

In order to achieve good contact between the refrigerant pipe 131 and the ice tray 121. In some embodiments, as shown in FIG. 9, the ice maker 120 further includes a bracket 136. The bracket 136 may be connected with the ice tray 121 by means of screws 137, so that the refrigerant pipe 131 may be fixed. For example, the refrigerant pipe 131 is fixed between the bracket 136 and the bottom of the ice tray 121. In some embodiments, the bracket 136 is in direct contact with the ice tray 121. Alternatively, a heat conductive material member is further provided between the bracket 136 and the ice tray 121, and the bracket 136 is in contact with the ice tray 121 through the heat conductive material member.

In order to promote a thermal circulation of an entire ice making compartment 100, as shown in FIGS. 9 and 12, the ice making compartment 100 further includes a fan compartment 150 and a fan 151, which are located at the front end of the ice maker 120. The bracket 136 is formed as a U-shaped bracket, and an air guide pipeline is formed between an inner surface (e.g., an upper surface) of the bracket 136 and the ice maker 120. A rear end of the air guide pipeline is open to form an opening 1362 (referring to FIG. 12). The fan compartment 150 includes an air inlet 152, and a front end of the air guide pipeline is connected with the fan compartment 150 through the air inlet 152. The air inlet 152 is located on a rear side of the fan compartment 150 and below the ice maker 120. An air outlet 153 is disposed on a front side of the fan compartment 150 (referring to FIG. 9). After the fan 151 operates, the fan compartment 150 continuously sucks air from the air guide pipeline and blows the air forward.

The air blown from the fan compartment 150 is blown to the front sidewall 118 of the ice making compartment shell 110, and then is diffused in all directions, and is mainly diffused downward. As a result, the air exchanges heat with different components in the entire ice making compartment 100 such as the ice storage box 119 and the ice crushing compartment 1180. When the tee maker 120 operates normally, a temperature of the refrigerant pipe 131 is low, and the air sucked from the air guide pipeline has a low temperature after exchanging heat with the refrigerant pipe 131, and the temperature is relatively low. After being blown out by the fan 151, the air is diffused to different regions, which facilitates cooling of the entire ice making compartment 100.

In order to well promote circulation of the air, as shown in FIG. 12, a plurality of openings 1361 are provided at a bottom of the bracket 136, and the air may enter the air guide pipeline through the plurality of openings 1361. After the water tray 160 is installed, the bracket 136 is located between the water tray 160 and the ice maker 120. Air near the water tray 160 may enter the air guide pipeline through the plurality of openings 1361, so that flow of the air near the water tray 160 is indirectly promoted, and a possibility of frosting of the water tray 160 is reduced.

Figure 14:
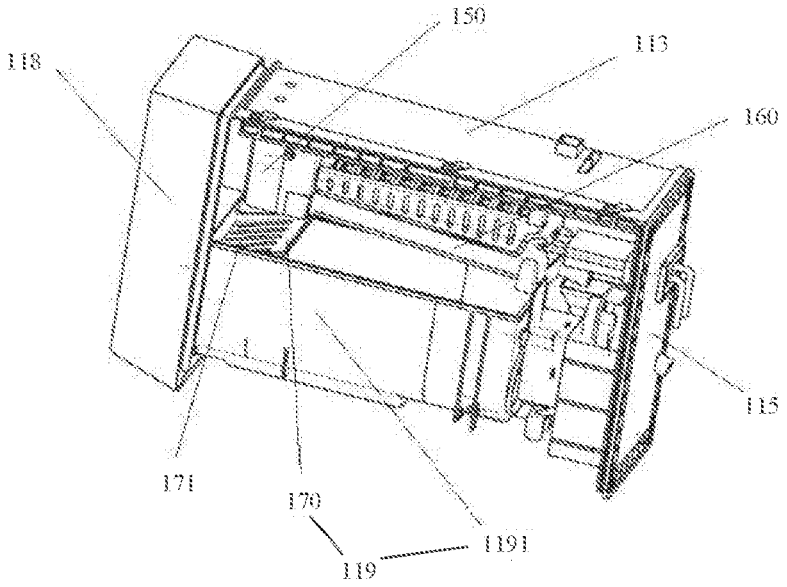
FIG. 14 is a diagram showing a structure of an ice making compartment of a refrigerator, in accordance with some embodiments.
Figure 15:
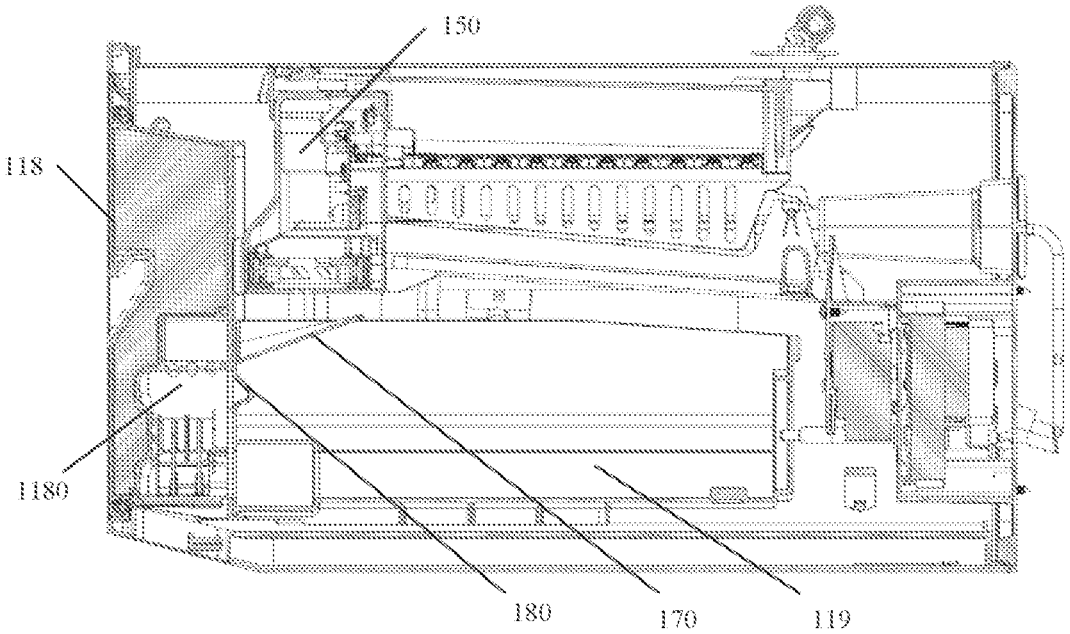
FIG. 15 is a cross-sectional view of an ice making compartment of a refrigerator, in accordance with some embodiments.
Figure 16:
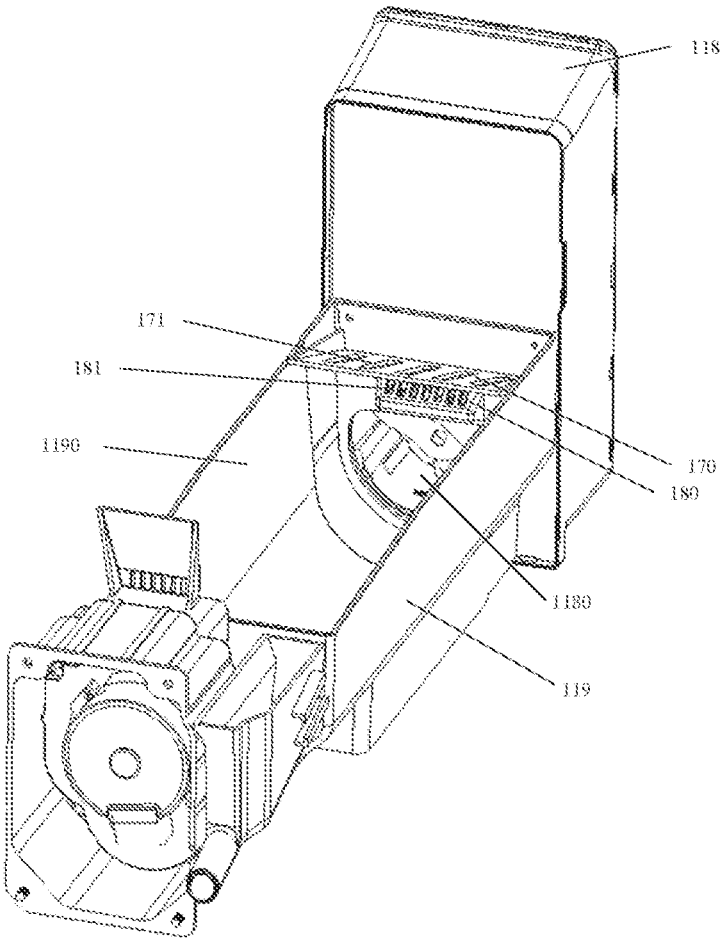
FIG. 16 is a diagram showing a structure of an ice storage box in an ice making compartment of a refrigerator, in accordance with some embodiments.

In some embodiments of the present disclosure, as shown in FIGS. 14, 15 and 16, the ice storage box 119 includes a box body 1191 and a first ice baffle 170. At least a part of the first ice baffle 170 is located in the box body 1191, and the first ice baffle 170 is configured to prevent the see cubes from accumulating at a position of the box body 1191 close to the door body 30. The first ice baffle 170 is located at a rear portion of the front sidewall 118 of the ice making compartment shell 110. For example, the first see baffle 170 is located at a rear portion of the rear shell 1182 of the front sidewall 118.

In some embodiments, the first ice baffle 170 may be formed as a plate structure. For example, a side of the first ice baffle 170 close to the door body 30 is fixed to the rear shell 1182 of the front sidewall 118, and a side of the first ice baffle 170 away from the door body 30 is inclined rearward and upward. The first ice baffle 170 includes a first ventilation opening 171. That is, the first ice baffle 170 includes one first ventilation opening 171, or the first ice baffle 170 includes a plurality of first ventilation openings 171. A size of each first ventilation opening 171 is smaller than a size of the ice tray 121, so as to prevent the ice cubes from passing through the first ventilation opening 171. For example, each first ventilation openings 171 is formed in an elongated shape, and extends in a front-rear direction. A dimension of the first ventilation opening 171 in a left-right direction is smaller than a dimension of the ice tray 121, so as to prevent the ice cubes from passing through the first ventilation opening 171.

As shown in FIG. 15, the first ice baffle 170 is located below the fan compartment 150. In some embodiments, the first baffle 170 is entirely located in the ice storage box 119. In some embodiments, the side (e.g., a front side) of the first ice baffle 170 close to the door body 30 is located at a top of the ice storage box 119, and the side (e.g., a rear side) of the first ice baffle 170 away from the door body 30 extends out of the ice storage box 119. A rear side of the first ice baffle 170 is arranged at an interval with each of the fan compartment 150 and the water tray 160 above the first ice baffle 170.

The ice storage box 119 further includes an see transport device configured to transport the ice cubes to the ice crushing compartment 1180 on a front side. The first ice baffle 170 may prevent the diffusion of the air blown from the fan compartment 150 from being affected due to excessive accumulation of the ice cubes at a front of the see storage box 119. In addition, the air blown from the fan compartment 150 may enter the see storage box 119 through the first ventilation opening 171.

In some embodiments, the first ice baffle 170 and the rear shell 1182 of the front sidewall 118 may be integrally formed.

In some embodiments, as shown in FIGS. 15 and 16, the ice storage box 119 further includes a second ice baffle 180, which is located at the rear portion of the front Sidewall 118 and at a lower front of the first see baffle 170. The second see baffle 180 may be formed as a plate structure. For example, a front side of the second ice baffle 180 is fixed to the rear shell 1182 of the front sidewall 118, and a rear side of the second see baffle 180 is inclined rearward and downward. The ice crushing compartment 1180 is connected with an ice storage cavity 1190 of the ice storage box 119, and the second ice baffle 180 is located at a connection port between the ice crushing compartment 1180 and the ice storage box 119, that is, the second ice baffle 180 is located above an ice inlet of the ice crushing compartment 1180.

As shown in FIG. 16, the second ice baffle 180 includes a second ventilation opening 181. That is, the second ice baffle 180 includes one second ventilation opening 181, or the second ice baffle 180 includes a plurality of second ventilation openings 181. A size of each second ventilation openings 181 is smaller than the size of the ice tray 121, so as to prevent the ice cubes from passing through the second ventilation opening 181. The air may circulate between the ice crushing compartment 1180 and the ice storage box 119 through the second ventilation opening 181.

The ice cubes enter the ice crushing compartment 1180 through the ice inlet of the ice crushing compartment 1180. The second ice baffle 180 may prevent the ice cubes from returning to the ice storage box 119 from the ice crushing compartment 1180 during operation of an ice crushing device in the ice crushing compartment 1180. In addition, by providing the second ventilation opening 181 in the second ice baffle 180, the air blown from the fan compartment 150 may enter the ice crushing compartment 1180 through the second ventilation opening 181, and an air circulation volume is increased.

In some embodiments, the second ice baffle 180 and the rear shell 1182 of the front sidewall 118 may be integrally formed.

In some embodiments, the ice storage box 119 includes both the first ice baffle 170 and the second ice baffle 180.

In some embodiments, the second ice baffle 180 and the first ice baffle 170 may be integrally formed.

The refrigerant pipe 131 is guided into the ice making compartment 100 from the outside of the inner container 15 of the refrigerating compartment. The refrigerant pipe 131 is connected with the cold air supply device 20 of the refrigerator 1, and extends to a vicinity of the ice making compartment 100 in the heat insulation material (e.g., a foamed layer) between the inner container 15 of the refrigerating compartment and the shell 14, and then passes through the inner container 15 of the refrigerating compartment and the ice making compartment shell 110 to enter the ice making compartment 100. For example, the refrigerant pipe 131 enters the ice making compartment 100 from the rear sidewall 115 of the ice making compartment shell 110.

During manufacturing of the refrigerator 1, the refrigerant pipe 131 usually needs to be installed first, and then the foaming is performed between the inner container 15 and the shell 14. Thus, there is a need to pre-fix the refrigerant pipe 131. Some embodiments of the present disclosure provide a fixed structure of the refrigerant pipe 131.

The fixed structure of the refrigerant pipe 131 includes a protector and a protector conduit. The protector is arranged around the refrigerant pipe 131 and inserted into the protector conduit; the protector conduit is disposed on the rear sidewall 115 of the ice making compartment shell 110, and extends toward an inside of the ice making compartment 100, and is configured to movement of the protector to the inside of the ice making compartment 100.

In some embodiments, a dimension of a cross section of the protector conduit perpendicular to the refrigerant pipe 131 gradually decreases from back to front.

As shown m FIGS. 7, 8 and 9, the refrigerant pipe 131 passes through the inner container 15 of the refrigerating compartment and the rear sidewall 115 of the ice making compartment shell 110, and then enters the ice making compartment 100. The protector conduit includes a first conduit 1151 and a second conduit 1152. The first conduit 1151 and the second conduit 1152 both extend toward a front of the ice making compartment 100, and the first conduit 1151 and the second conduit 1152 are connected.

As shown in FIG. 4C, the rear sidewall 115 includes a substrate 1150 located on a front side of the rear sidewall 115, and the first conduit 1151 extends from the substrate 1150 toward a front side of the ice making compartment 100. The first conduit 1151 includes a bending surface 11511 located at a front end of the first conduit 1151. The bending surface 11511 is bent toward a center of the first conduit 1151. The second conduit 1152 extends from the bending surface 11511 toward the front side of the ice making compartment 100.

The protector includes a lower protector 133 and an upper protector 134. In some embodiments, the upper protector 134 and the lower protector 133 may be integrally formed, and the refrigerant pipe 131 is nested in the protector.

In some embodiments, as shown in FIGS. 7 and 8, the lower protector 133 includes a first lower protector 1331 and a second lower protector 1332, and the upper protector 134 includes a first upper protector 1341 and a second upper protector 1342. The first upper protector 1341 and the first lower protector 1331 are arranged opposite to each other, and the second upper protector 1342 and the second lower protector 1332 are arranged opposite to each other. An outer size of the first upper protector 1341 and the first lower protector 1331 after they are fixed is matched with an inner size of the first conduit 1151, and is larger than an inner size of the second conduit 1152. An outer size of the second upper protector 1342 and the second lower protector 1332 after they are fixed is matched with the inner size of the second conduit 1152.

After the protector is arranged around the refrigerant pipe 131, the protector and the refrigerant pipe 131 are inserted into the first conduit 1151 and the second conduit 1152. At least parts of the second upper protector 1342 and the second lower protector 1332 are located in the second conduit 1152, and at least parts of the first upper protector 1341 and the first lower protector 1331 are located in the first conduit 1151. In addition, the bending limit surface 11511 is able to the first upper protector 1341 and the first lower protector 1331, and prevent the first upper protector 1341 and the first lower protector 1331 from entering the second conduit 1152, so as to control an insertion depth of the protector. By using the protector the first conduit 1151 and the second conduit 1152 to jointly movement of the refrigerant pipe in up-down and left-right directions, the movement of the refrigerant pipe 131 may be limited, the refrigerant pipe 131 may be preliminary fixed the refrigerant pipe 131 may be protected, and the refrigerant pipe 131 may be in good contact with the refrigerant.

In some embodiments, parts of the second upper protector 1342 and the second lower protector 1332 extend from a front side of the second conduit 1152.

In some embodiments, a dimension of a cross section of the first conduit 1151 perpendicular to the refrigerant pipe 131 gradually decreases from back to front. A dimension of a cross section of the first upper protector 1341 and the first lower protector 1331 perpendicular to the refrigerant pipe 131 gradually decreases from back to front, so as to be matched with the first conduit 1151.

In some embodiments, as shown in FIG. 8, the fixed structure of the refrigerant pipe 131 further includes a fixing piece 135 fixed to the rear sidewall 115, and the protector is located at a front of the fixing piece 135. The fixing piece 135 is able to a rearward movement of the protector and cooperates with the bending limit surface 11511 on a front side to movement of the refrigerant pipe 131 in a front-rear direction, so that the refrigerant pipe 131 is preliminarily positioned.

In some embodiments, the fixing piece 135 includes an accommodating groove 1351 with an opening on a side, and the refrigerant pipe 131 is nested in the accommodating groove 1351 to facilitate installation of the fixing piece 135.

As shown m FIGS. 17A to 20, the refrigerator 1 further includes a water supply system 200. The water supply system 200 may be connected with an external water source. The water supply system 200 includes a water storage tank 250, which is usually located in the refrigerating compartment 10A.

Figure 17A:
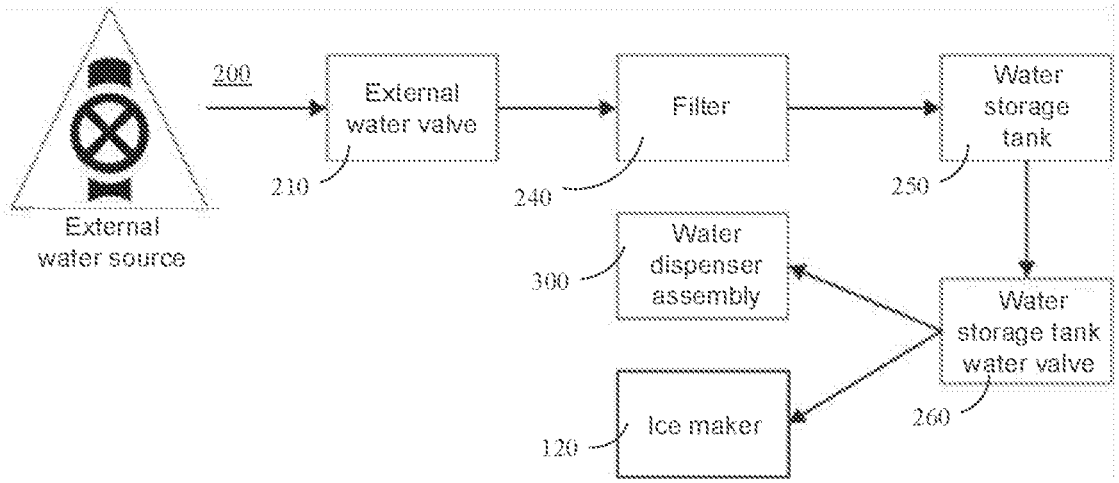
FIG. 17A is a schematic diagram of a water supply system of a refrigerator, in accordance with some embodiments.

As shown in FIG. 17A, the external water source is connected with a water inlet 254 of the water storage tank 250 after sequentially passing through an external water valve 210 and a filter 240. A water outlet 255 of the water storage tank 250 is connected with a water supply pipeline of a water dispenser assembly 300 and the ice maker 120 through a water storage tank water valve 260, so as to supply water to the water dispenser assembly 300 and the ice maker 120 separately.

Figure 18:
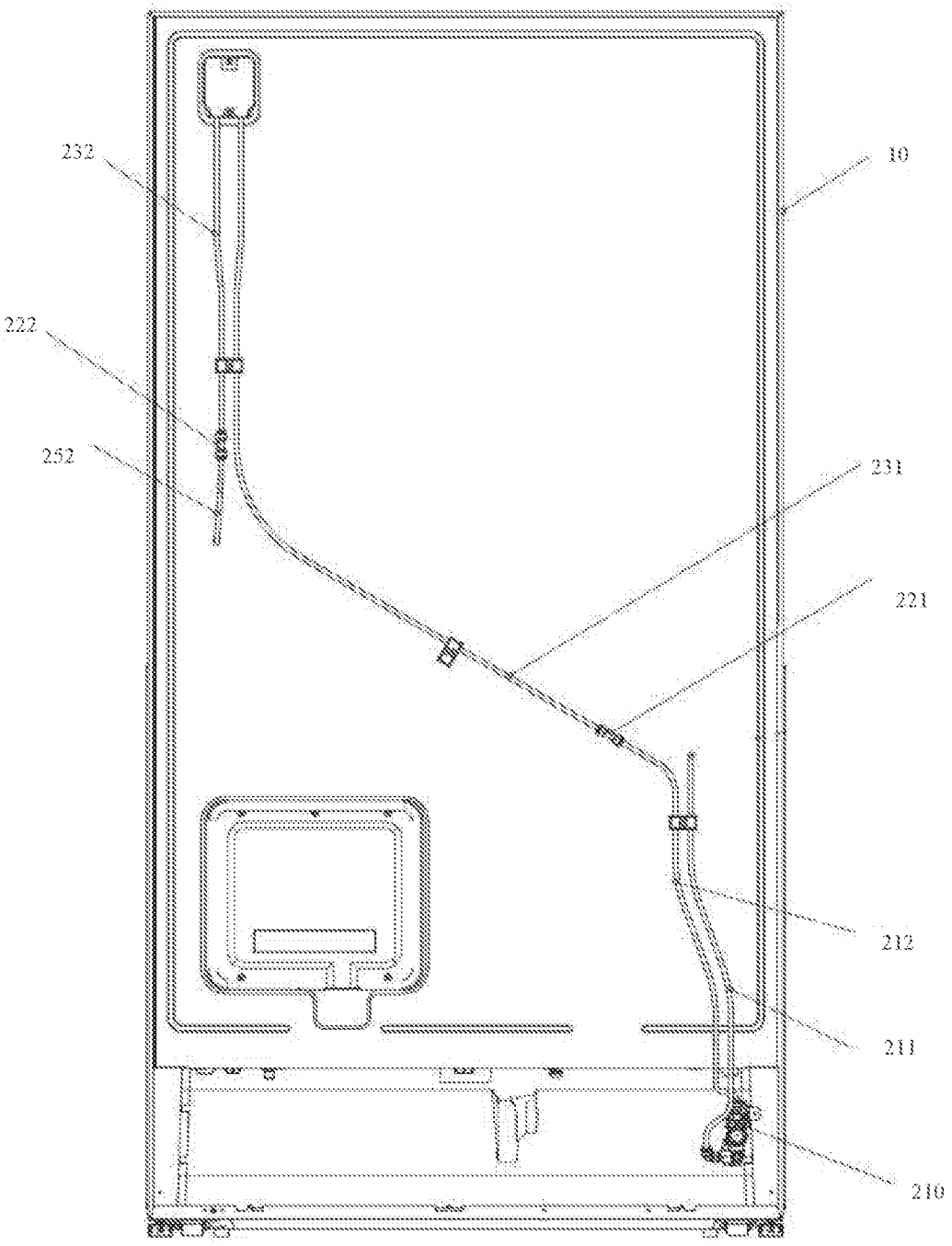
FIG. 18 is a rear perspective view of a water supply system of a refrigerator, in accordance with some embodiments.
Figure 19:
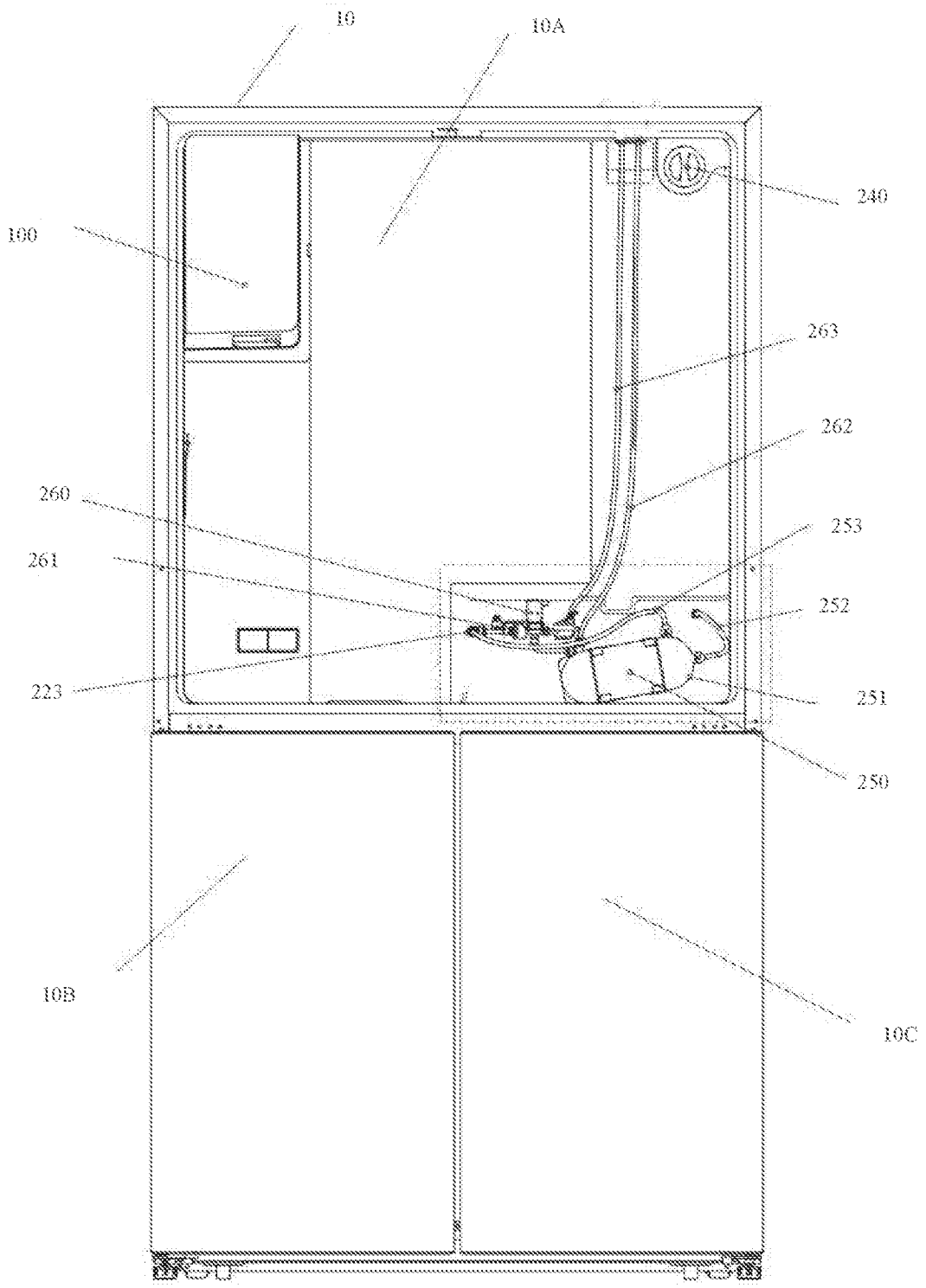
FIG. 19 is a front perspective view of a water supply system of a refrigerator, in accordance with some embodiments.
Figure 20:
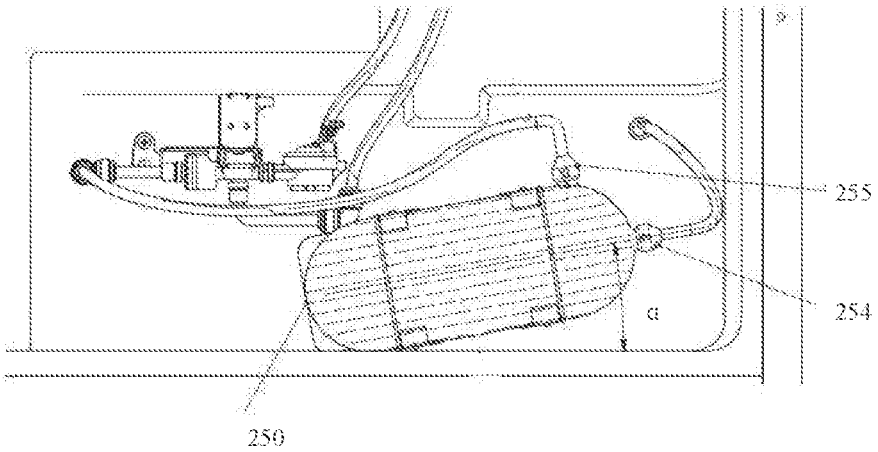
FIG. 20 is an enlarged view of a local structure of a water storage tank in FIG. 19.

As shown in FIGS. 18 to 20, a water inlet pipe 211 in the water supply system 200 is connected with the external water source, so that the external water source is guided into the water supply system 200 of the refrigerator 1. A water outlet pipe 212 of the external water valve 210 is connected with an end of a first water pipe 231 through a first quick connector 221 and another end of the first water pipe 231 is connected with a water inlet of the filter 240 to guide the external water source into the filter 240 for filtering. An end of a second water pipe 232 is connected with a water outlet of the filter 240, and another end of the second water pipe 232 is connected with a water inlet pipe 252 of the water storage tank 250 through a second quick connector 222, so as to guide the filtered drinking water into a tank body 251 of the water storage tank 250 for pre-cooling. A water outlet pipe 253 of the water storage tank 250 is connected with a water inlet pipe 261 of the water storage tank water valve 260 through a third quick connector 223, so as to guide the pre-cooled drinking water to the water dispenser assembly 300 and the ice maker 120, which facilitates people to drink cold water or accelerates an ice making speed.

In some embodiments, the external water valve 210 has "one inlet and one outlet", that is, the external water valve 210 is connected with one water inlet pipe and one water outlet pipe, the water storage tank water valve 260 has "one inlet and two outlets", that is, the water storage tank water valve 260 is connected with one water inlet pipe and two water outlet pipes, in which a water outlet pipe 262 is connected with the water dispenser assembly 300, and another water outlet pipe 263 is connected with the ice maker 120.

In some embodiments, the external water valve 210 is located outside the shell 14 of the refrigerator 1, which facilitates direct connection with the external water source.

In some embodiments, the external water valve 210 is located at a compartment accommodating the compressor 21.

In some embodiments, the water storage tank water valve 260 is located inside the inner container 15 of the refrigerating compartment, which facilitates connection with the water dispenser assembly 300 and the ice maker 120.

In some embodiments, the water storage tank water valve 260 is located in the refrigerating compartment 10A.

In some embodiments, the filter 240 is disposed inside the refrigerating compartment 10A. A water supply pipeline from the external water valve 210 to the filter 240 needs to pass through the foamed layer of the refrigerator 1. The foamed layer of the refrigerator 1 is located between the shell 14 and the inner container 15 of the refrigerating compartment.

In some embodiments, the filter 240 and the water storage tank 250 are provided at different positions of the refrigerating compartment 10A. A water supply pipeline from the filter 240 to the water storage tank 250 needs to first pass through the foamed layer of the refrigerator 1 to reach an outside of the refrigerating compartment 10A, then extends from the outside of the refrigerating compartment 10A to a position of the water storage tank 250, and finally passes through the foamed layer of the refrigerator 1 again to enter the refrigerating compartment 10A and be connected with the water storage tank 250. The foamed layer of the refrigerator 1 is located between the shell 14 and the inner container 15 of the refrigerating compartment.

In some embodiments, the filter 240 is disposed outside the refrigerating compartment 10A, and the water storage tank 250 is disposed inside the refrigerating compartment 10A. The water supply pipeline from the filter 240 to the water storage tank 250 needs to pass through the foamed layer of the refrigerator 1. The foamed layer of the refrigerator 1 is located between the shell 14 and the inner container 15 of the refrigerating compartment.

In some embodiments, at least a part of a water supply pipeline from the water storage tank 250 to the ice maker 120 is located outside the refrigerating compartment 10A. The water supply pipeline from the water storage tank 250 to the ice maker 120 first passes through the foamed layer of the refrigerator 1 to reach the outside of the refrigerating compartment 10A, then extends from the outside of the refrigerating compartment 10A to a position of toe ice maker 120, and finally passes through the foamed layer of the refrigerator 1 again to enter the refrigerating compartment 10A and be connected with the ice maker 120. The foamed layer of the refrigerator 1 is located between the shell 14 and the inner container 15 of the refrigerating compartment. In some cases, when connected with the ice maker 120, the water supply pipeline from the water storage tank 250 to the ice maker 120 also needs to pass through the ice making compartment shell 110, such as the upper sidewall 113 or the rear sidewall 115.

In some embodiments, at least a part of a water supply pipeline from the water storage tank 250 to the water dispenser assembly 300 is located outside the refrigerating compartment 10A. The water supply pipeline from the water storage tank 250 to the water dispenser assembly 300 first passes through the foamed layer of the refrigerator 1 to reach the outside of the refrigerating compartment 10A, then extends from the outside of the refrigerating compartment 10A to a position of the water dispenser assembly 300, and finally passes through the foamed layer of the refrigerator 1 again to enter the refrigerating compartment 10A and supply water to the water dispenser assembly 300.

In some embodiments, as shown in FIG. 17A, a working process of the water supply system 200 during use of water is as follows.

When the water supply system 200 receives a drinking command, the external water valve 210 and a valve in the water storage tank water valve 260 that corresponds to the water outlet pipe 262 are opened. The external water source sequentially flows to the external water valve 210, the filter 240, the water storage tank 250, and the water outlet pipe 262 of the water storage tank water valve 260 due to action of water pressure, and finally flows from a wafer outlet of the water dispenser assembly 300.

When the water supply system 200 receives an ice making command, the external water valve 210 and a valve in the water storage tank water valve 260 that corresponds to the water outlet pipe 263 are opened. The external water sequentially flows to the external water valve 210, the filter 240, the water storage tank 250, and the water outlet pipe 263 of the water storage tank water valve 260 due to the action of the water pressure, and finally enters the ice maker 120 to start ice making.

When the water supply system 200 simultaneously receives the drinking command and the ice making command, the external water valve 210 and the valves in the water storage tank water valve 260 that correspond to the water outlet pipe 262 and the water outlet pipe 263 are all opened. The external water sequentially flows to the external water valve 210, the filter 240, the water storage tank 250, and the water outlet pipe 262 and the water outlet pipe 263 of the water storage tank water valve 260 due to the action of the water pressure, and finally flows from the water outlet of the water dispenser assembly 300 and enters the ice maker 120 to start making ice.

The above is a basic control logic of the water supply system 200 during operation of the water dispenser assembly 300 and the ice maker 120.

In some embodiments, when the pre-cooled low-temperature water in the tank body 251 of the water storage tank 250 flows from the water dispenser assembly 300 or enters the ice maker 120, external high-temperature water (e.g., at a temperature in a range of 25° C. to 80° C. inclusive) enters the water storage tank 250. At this time, the tank body 251 will expand and increase in volume when heated; subsequently, as a temperature in the refrigerating compartment 10A decreases, the tank body 251 will contract and decrease in volume. When the high-temperature water enters the tank body 251, an extra part of water which is stored in the tank body 251 when the tank body expands and increases in volume when heated, flows to the water outlet pipe 253 of the water storage tank 250, and is discharged through the water outlet pipe 262 and the water outlet pipe 263 of the water storage tank water valve 260 during the contraction when the tank body is cooled. When the water is discharged through the water outlet of the water dispenser assembly 300, a problem of water leakage from a drinking port of the water dispenser assembly 300 may occur, and when the water enters the ice maker 120, a problem of freezing of a water injection port of the ice maker 120 may occur.

In some embodiments, the water storage tank 250 further includes the water storage tank water valve 260. After the drinking command or the ice making command is accomplished, the water storage tank water valve 260 is closed, so that the water outlet pipe 253 of the water storage tank 250, the water outlet pipe 262 of the water storage tank water valve 260 connected with the water dispenser assembly 300, and the water outlet pipe 263 of the water storage tank water valve 260 connected with the ice maker 120 are all closed. As a result it is possible to prevent water extruded due to the thermal expansion and contraction of the water storage tank 250 from seeping from the drinking port of the water dispenser assembly 300 or the water injection port of the ice maker 120.

In some embodiments, the water supply system 200 includes two or more water valves. After water intake is accomplished, there are requirements on a sequence of closing times of these water valves. For example, the external water valve 210 located on an upstream side of the water storage tank 250 is closed first, and after a first time interval, the water storage tank water valve 260 located on a downstream side of the water storage tank 250 is closed, and a part of the water in the tank body 251 is discharged by virtue of inertia.

Since the water storage tank water valve 260 is disposed on the downstream side of the water storage tank 250, after the pre-coded drinking water (e.g., at a temperature in a range of 1° C. to 5° C. inclusive) in the tank body 251 is discharged, the external high-temperature water (e.g., at the temperature in the range of 25° C. to 80° C. inclusive) enters the tank body 251, and the tank body 251 expands after being heated, and then contracts as the temperature in the refrigerating compartment 10A decreases. When a water supply pipeline of the water storage tank 251 is closed by the water storage tank water valve 260, a certain internal pressure is generated in the tank body 251. With extension of the first time interval the internal pressure generated in the tank body 251 gradually increases, which causes stress impact on the water storage tank 250 and other waterway components; as the number of execution times of the drinking command or the see making command is accumulated, the stress impact is continuously generated and accumulated, thereby reducing durability of the water storage tank 250 and other waterway components connected with the water storage tank 250. For this reason, a value of the first time interval should not be excessively large. For example, the value of the first time interval is in a range of 0.1 s to 5 s inclusive. The value of the first time interval is related to a relative positional relationship between the external water valve 210 and the water storage tank water valve 260, and a layout of the water supply pipeline. For example, the first time interval may be 0.1 s, 0.5 s, 0.8 s, 1 s, 1.5 s, 2 s, 2.5 s, 3 s, 3.5 s, 4 s, 4.5 s, or 5 s.

For a refrigerator 1 with an automatic drinking function, there exist problems of incomplete water flow and dripping after water intake of the water dispenser assembly 300. An important reason is that there is gas in the components or the water supply pipelines of the water supply system 200. For example, bubbles in the water cannot be completely discharged. After the external water source is injected into the water supply system 200, the bubbles are mixed in the water flow, which causes discontinuous and incomplete water flow at the water outlet of the water dispenser assembly 300, and in turn causes the problems of incomplete water flow and dripping after the water intake. It has been found through research that, a waterway component that is most prone to an air trapping problem is the water storage tank 250.

In some embodiments, the water storage tank 250 includes a water inlet 254 and a water outlet 255. The water inlet 254 is located below the water outlet 255 (e.g., the water inlet 254 being disposed lower than the water outlet 255). When the water is injected for a first time, the water sequentially fills the tank body 251 from bottom to top, so as to ensure that air in the tank body 251 is discharged before the water fills the tank body 251.

In some embodiments, the water outlet 255 is provided at a highest position of the tank body 251. For example, after the water storage tank 250 is assembled and fixed, there is no position as high as or higher than the water outlet 255 in the water storage tank 250. In order to achieve this effect, a position where the water storage tank 250 is assembled and fixed is critical. There is a need to fully consider a relative position of the water outlet 255 in the tank body 251, and to reasonably design relative positions of the water storage tank 250 and a bottom surface of the inner container 15 of the refrigerating compartment 10A.

In some embodiments, the tank body 251 of the water storage tank 250 is formed as a columnar body (e.g., a cylinder) with two hemispherical ends. The tank body 251 is obliquely placed in the refrigerating compartment 10A. The water outlet 255 is located in a hemispherical portion at a higher end of the tank body 251.

In some embodiments, a lower end of the tank body 251 is located at a bottom of the refrigerating compartment 10A. The water outlet 255 is located in the hemispherical portion at the higher end of the tank body 251. An included angle between a central axis of the tank body 251 in a longitudinal direction of the lank body 251 and the bottom surface of the refrigerating compartment 10A is a (as shown in FIG. 20). After the water storage tank 250 is assembled and fixed, the water outlet 255 is located at the highest position of the tank body 251, and there is no position as high as or higher than the water outlet 255 in the water storage tank 250.

A value of a needs to be determined by comprehensively considering factors such as a structure of the water storage tank 250, space of an inner bottom surface of the refrigerating compartment 10A, and the relative position of the water storage tank 250 assembled and fixed on the inner bottom surface of the refrigerating compartment 10A. On a premise of not affecting assembly performance and manufacturability, a large value should be preferred. For example, $\alpha$ is greater than or equal to 5° and less than or equal to 75° (i.e., $5° \leq \alpha \leq 75°$), and $\alpha$ may be 8°, 10°, 15°, 20°, 25°, 30°, 35° or 45°. When the water is injected, the external water source flows into the tank body 251 through the water inlet 254, and the water outlet 255 is finally filled with water to ensure that the air in the tank body 251 is completely discharged; when the water is taken, the water is first discharged through the water outlet 255, thereby solving the problems of incomplete water flow and dripping after the water intake of the water dispenser assembly 300.

For a refrigerator 1 with an ice making function or the automatic drinking function, an external water source of the refrigerator 1 is directly connected with a household water delivery system. When water pressure of the water delivery system is unstable, as the water pressure fluctuates, components of the water supply system 200 will be subjected to continuous impact of the water pressure, so that durability of the components are reduced. In some embodiments, the wafer supply system 200 includes the external water valve 210, and the external water valve 210 is provided between the external water source and the filter 240 in a non-working state (e.g., when the drinking command or the ice making command is not executed), the external water source and the water supply system 200 may be closed through the external water valve 210, thereby protecting key components of the water supply system 200 (e.g., the water storage tank 250 and the filter 240) from the impact caused by the fluctuation of the water pressure.

In some embodiments, the pre-cooled cold drinking water in the water storage tank 250 is supplied to the water dispenser assembly 300 and the ice maker 120 separately. However the present disclosure is not limited thereto.

Figure 17B:
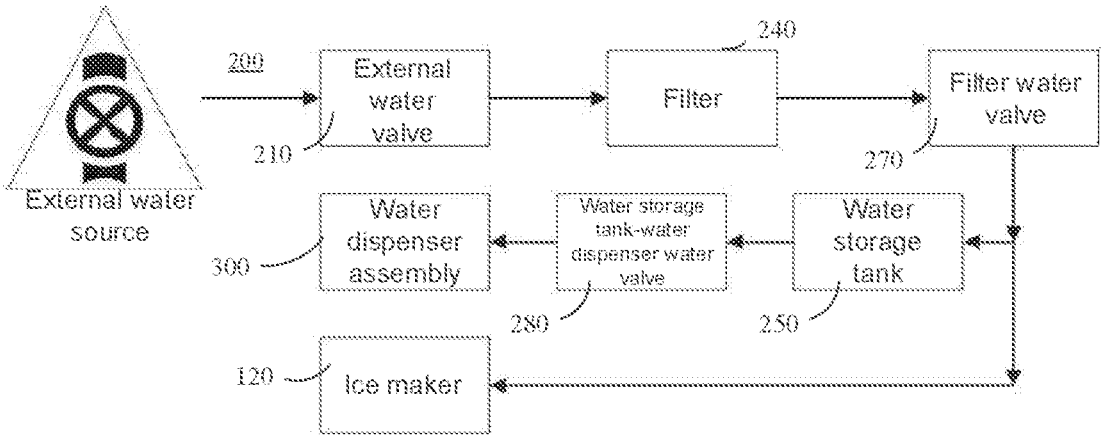
FIG. 17B is a schematic diagram of another water supply system of a refrigerator, in accordance with some embodiments.

In some embodiments, as shown in FIG. 17B, the pre-cooled cold drinking water in the water storage tank 250 is supplied to the water dispenser assembly 300 separately, so as to reduce interference of the newly injected external high-temperature water on the temperature of the cold drinking water when the ice making command is executed. The water supply system 200 includes a filter water valve 270 located on a downstream side of the filter 240, and the filter water valve 270 is connected with the ice maker 120 and the water storage tank 250 separately. When water needs to be supplied to the water dispenser assembly 300, water flowing from the filter 240 flows into the water storage tank 250, and then further flows to the water dispenser assembly 300 through the water storage tank 250. In addition, the water supply system 200 further includes a water storage tank-water dispenser water valve 280 located between the water storage tank 250 and the water dispenser assembly 300. The water storage tank-water dispenser water valve 280 is configured to control working and stopping of a waterway from the water storage tank 250 to the water dispenser assembly 300.

In some embodiments, there are requirements on a sequence of closing times of the filter water valve 270 and the water storage tank-water dispenser water valve 280. For example, the filter water valve 270 is closed first, and after a second time interval, the water storage tank-water dispenser water valve 280 is closed.

In some embodiments, there are no special requirements on a sequence of closing times of the filter water valve 270 and the external water valve 210 that are located on the upstream side of the water storage tank 250. For example, the filter water valve 270 and the external water valve 210 may be closed simultaneously. In some embodiments, it may also be possible that the external water valve 210 is closed first, and the filter water valve 270 is closed after a third time interval.

The water supply systems 200 in FIGS. 17A and 17B each include the filter 240.

In some embodiments, in a case where a water filtration and purification device has been installed in the household water delivery system of the user, the filter 240 in the water supply system 200 may be removed. The water supply systems 200 in FIGS. 17C and 17D each do not include the filter 240.

Figure 17C:
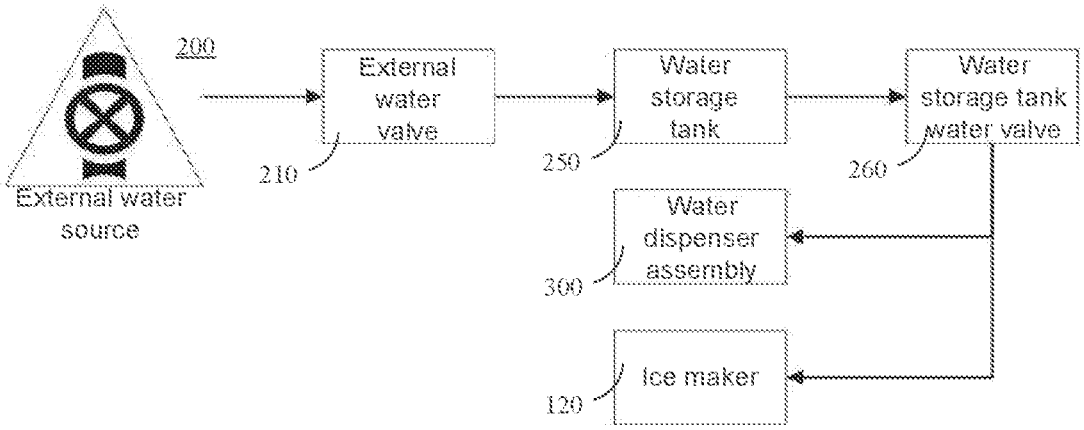
FIG. 17C is a schematic diagram of yet another water supply system of a refrigerator, in accordance with some embodiments.

As shown in FIG. 17C, in some embodiments, in a case where the pre-cooled cold drinking water in the water storage tank 250 is supplied to the water dispenser assembly 300 and the ice maker 120 separately, the external water valve 210 is connected with the water storage tank 250, and the water storage tank 250 is connected with the water dispenser assembly 300 and the ice maker 120 separately through the water storage tank water valve 260. Water from the external water source flows to the water storage tank 250 through the external water valve 210, and then flows to the water storage tank water valve 260. After passing through the water storage tank water valve 260, the water is divided into two sub-streams, in which one sub-stream leads to the water dispenser assembly 300, and another sub-stream leads to the ice maker 120.

In some embodiments, there are requirements on a sequence of closing times of the external water valve 210 and the water storage tank water valve 260. For example, the external water valve 210 located on the upstream side of the water storage tank 250 is closed first, and after a fourth time interval, the water storage tank water valve 260 of the water storage tank 250 is closed.

Figure 17D:
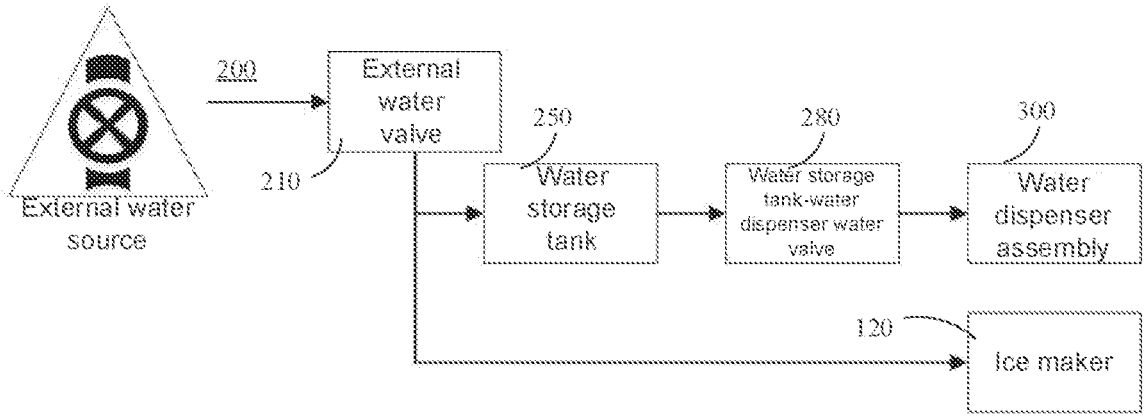
FIG. 17D is a schematic diagram of yet another water supply system of a refrigerator, in accordance with some embodiments.

As shown in FIG. 17D, in some embodiments, the external water valve 210 is connected with the ice maker 120 and the water storage tank 250 separately, and the water storage tank 250 is connected with the water storage tank-water dispenser water valve 280. The pre-cooled cold drinking water in the water storage tank 250 is supplied to the water dispenser assembly 300 separately. The water from the external water source flows into the external water valve 210, and after passing through the external water valve 210, the water is divided into two sub-streams, in which one sub-stream directly leads to the ice maker 120, and another sub-stream leads to the water storage tank 250, then flows to the water storage tank-water dispenser water valve 280 through the water storage tank 250, and then flows to the water dispenser assembly 300.

In some embodiments, there are requirements on a sequence of closing times of the water storage tank-water dispenser water valve 280 and the external water valve 210. For example, the external water valve 210 located on the upstream side of the water storage tank 250 is closed first and after a fifth time interval, the water storage tank-water dispenser water valve 280 located on the downstream side of the water storage tank 250 is closed.

In some embodiments, the refrigerator 1 includes at least one of the ice maker 120 or the water dispenser assembly 300. For example, a refrigerator 1 includes only the ice maker 120, or the refrigerator 1 includes only the water dispenser assembly 300, or the refrigerator 1 includes both the ice maker 120 and the water dispenser assembly 300. In a case where the refrigerator 1 includes only the ice maker 120, or in a case where the refrigerator 1 includes only the water dispenser assembly 300, the water supply system 200 may be adaptively added or removed, but a layout and a working principle thereof are same as those previously described. The first time interval, the second time interval, the third time interval, the fourth time interval, and the fifth time interval may be same or different.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

A person skilled in the art will understand that, the scope of disclosure involved in the present disclosure is not limited to technical solutions formed by specific combinations of the above technical features, and shall cover other technical solutions formed by any combination of the above technical features or their equivalent features without departing from the concept of disclosure, such as technical solutions formed by replacing the above features with technical features with similar functions disclosed in some embodiments (but not limited thereto).

What is claimed is:

1. A refrigerator, comprising:

a refrigerator body including a storage compartment;

a door body configured to open or close the storage compartment; and an ice making compartment disposed in the storage compartment, wherein the ice making compartment includes:

an ice making compartment shell including a lower sidewall, a right sidewall, an upper sidewall, a left sidewall, a rear sidewall and a front sidewall, wherein the front sidewall is arranged proximate to the door body, and the rear sidewall is arranged away from the door body;

an ice maker located in the ice making compartment shell and configured to make ice cubes;

an ice storage box located below the ice maker and configured to store the ice cubes made by the ice maker, the ice storage box including a box body and a second ice baffle provided at a rear portion of the front sidewall of the ice making compartment; and a water supply system, the ice maker being connected with the water supply system, so that the water supply system supplies water to the ice maker; wherein the water supply system includes:

a water storage tank, a water outlet of the water storage tank being arranged higher than a water inlet of the water storage tank;

the water storage tank is located at a bottom of the storage compartment, and the water storage tank is obliquely arranged;

an included angle between a central axis of a tank body of the water storage tank in a longitudinal direction of the tank body and a bottom surface of the storage compartment is $\alpha$, and $\alpha$ is greater than or equal to 5° and less than or equal to 75° ($5° \leq \alpha \leq 75$).

2. The refrigerator according to claim 1, wherein the ice storage box further includes a first ice baffle, at least a part of the first ice baffle is located in the box body;

the first ice baffle is configured to prevent the ice cubes from accumulating at the box body;

the first ice baffle includes a first ventilation opening, and the ice making compartment further includes:

a fan compartment located on a side of the ice maker proximate to the door body, the first ice baffle being located below the fan compartment; and a fan located in the fan compartment; wherein the fan blows air in the fan compartment into the ice storage box through the first ventilation opening.

3. The refrigerator according to claim 2, wherein the first ventilation opening of the first ice baffle has a strip shape, and the first ventilation opening is configured to extend in a direction from a side of the first ice baffle proximate to the door body to a side of the first ice baffle away from the door body.

4. The refrigerator according to claim 2, wherein the ice making compartment further includes:

a water tray assembly located between the ice maker and the ice storage box, wherein the water tray assembly includes a water tray configured to receive water drops dripping during an ice making process of the ice maker;

the water tray is connected with the ice maker and is located on a side of the fan compartment away from the door body, and a side of the first ice baffle away from the door body is arranged at an interval with each of the fan compartment and the water tray.

5. The refrigerator according to claim 4, wherein the ice maker includes an ice maker body and a clamping shaft, the clamping shaft is located at an end of the ice maker body away from the door body; the water tray includes a water tray body and a clamping hook matched with the clamping shaft, and the clamping hook is located at an end of the water tray body away from the door body;

the water tray body is configured to incline downward from an end of the water tray body proximate to the door body to the end of the water tray body away from the door body.

6. The refrigerator according to claim 5, wherein the water tray assembly further includes:

a flow guide opening connected with the end of the water tray body away from the door body; and a water funnel located below the flow guide opening and located on the rear sidewall.

7. The refrigerator according to claim 1, wherein the ice storage box further includes a first ice baffle, at least a part of the first ice baffle is located in the box body;

a side of the first ice baffle proximate to the door body is located in the box body and is connected with the front sidewall, and a side of the first ice baffle away from the door body extends in a direction away from a bottom of the box body.

8. The refrigerator according to claim 7, wherein the ice making compartment further includes an ice crushing compartment located on a side of the ice storage box proximate to the door body, and a side of the ice crushing compartment away from the door body is connected with the ice storage box;

the second ice baffle is located below the first ice baffle, and the second ice baffle is configured to prevent ice cubes in the ice crushing compartment from returning to the ice storage box.

9. The refrigerator according to claim 8, wherein a side of the second ice baffle proximate to the door body is connected with the front sidewall, and a side of the second ice baffle away from the door body extends in a direction toward the bottom of the box body.

10. The refrigerator according to claim 9, wherein the door body includes a dispenser configured to receive the ice cubes made by the ice maker;

a side of the ice crushing compartment proximate to the door body is connected with the dispenser, and the second ice baffle is located at a connection port between the ice crushing compartment and the ice storage box.

11. The refrigerator according to claim 8, wherein the front sidewall includes a front shell and a rear shell, between which the ice crushing compartment is defined;

the first ice baffle and the second ice baffle are both connected with the rear shell of the front sidewall.

12. The refrigerator according to claim 8, wherein the second ice baffle includes a second ventilation opening.

13. The refrigerator according to claim 12, wherein the ice maker includes:

an ice tray configured to make ice cubes; wherein a size of the second ventilation opening of the second ice baffle and a size of a first ventilation opening of the first ice baffle are both smaller than a size of the ice tray.

14. The refrigerator according to claim 8, wherein the first ice baffle and a rear shell of the front sidewall are an integral structural member; or the second ice baffle and the rear shell of the front sidewall are an integral structural member; or the first ice baffle, the second ice baffle, and the rear shell of the front sidewall are an integral structural member.

15. The refrigerator according to claim 1, wherein the ice maker includes:

an ice tray configured to make ice cubes;

a refrigerant pipe located below the ice tray and at least partially in contact with the ice tray; and a bracket located below the refrigerant pipe and connected with the ice tray to fix the refrigerant pipe.

16. The refrigerator according to claim 15, wherein the ice making compartment further includes a fixed structure of the refrigerant pipe, and the fixed structure includes:

a protector located on a peripheral side of the refrigerant pipe;

a protector conduit, the protector being inserted into the protector conduit, and the protector conduit being disposed on a rear sidewall of the ice making compartment shell away from the door body, and extending toward an inside of the ice making compartment, and being configured to limit movement of the protector toward the inside of the ice making compartment; and a fixing piece located on a side of the rear sidewall away from the protector conduit, and disposed on the peripheral side of the refrigerant pipe.

17. The refrigerator according to claim 16, wherein the protector includes a lower protector and an upper protector;

the lower protector includes a first lower protector and a second lower protector connected with each other, and the upper protector includes a first upper protector and a second upper protector connected with each other;

the first upper protector and the first lower protector are arranged opposite to each other, and the second upper protector and the second lower protector are arranged opposite to each other;

the protector conduit includes a first conduit and a second conduit connected with each other; a dimension of a cross section of the first conduit perpendicular to the refrigerant pipe gradually decreases in a direction pointing from the rear sidewall to the front sidewall; and/or, a dimension of a cross section of the second conduit perpendicular to the refrigerant pipe gradually decreases in the direction pointing from the rear sidewall to the front sidewall;

an outer size of an integral structure of the first upper protector and the first lower protector is matched with an inner size of the first conduit;

an outer size of an integral structure of the second upper protector and the second lower protector is matched with an inner size of the second conduit; and the outer size of the integral structure of the first upper protector and the first lower protector is smaller than the inner size of the second conduit.

18. The refrigerator according to claim 15, wherein the ice making compartment further includes a water tray assembly located between the ice maker and the ice storage box, and the water tray assembly includes a water tray configured to receive water drops dripping during an ice making process of the ice maker;

the bracket is located between the water tray and the ice tray, and a plurality of openings are provided at a bottom of the bracket;

an air guide pipeline is disposed between the bracket and the ice tray, and the plurality of openings are configured to connect a space between the water tray and the bracket with the air guide pipeline.

* * * * *